US011959213B2

(12) United States Patent
Shiratsuchi

(10) Patent No.: US 11,959,213 B2
(45) Date of Patent: Apr. 16, 2024

(54) BOBBIN WINDING DEVICE AND SEWING MACHINE

(71) Applicant: JANOME SEWING MACHINE CO., LTD., Tokyo (JP)

(72) Inventor: Hiroki Shiratsuchi, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 566 days.

(21) Appl. No.: 17/339,470

(22) Filed: Jun. 4, 2021

(65) Prior Publication Data

US 2021/0404101 A1 Dec. 30, 2021

(30) Foreign Application Priority Data

Jun. 26, 2020 (JP) ..... 2020-110339
Apr. 6, 2021 (JP) ..... 2021-064646

(51) Int. Cl.
*D05B 57/26* (2006.01)
*D05B 59/04* (2006.01)

(52) U.S. Cl.
CPC ..... *D05B 57/26* (2013.01); *D05B 59/04* (2013.01)

(58) Field of Classification Search
CPC ..... D05B 57/26; D05B 57/00; D05B 57/24; D05B 59/04; D05B 59/00
See application file for complete search history.

(56) References Cited

U.S. PATENT DOCUMENTS 3,581,687 A * 6/1971 Meier ..... D05B 59/00 112/279
3,670,974 A * 6/1972 Ueltschi ..... D05B 59/00 242/484.8
5,816,512 A * 10/1998 Nakashima ..... D05B 59/00 242/484.7
2018/0127907 A1* 5/2018 Shiraishi ..... D05B 59/02
2020/0340159 A1 10/2020 Ueda et al.

FOREIGN PATENT DOCUMENTS

JP H05-261191 A 10/1993
JP 2002066184 A * 3/2002
JP 2010273892 A * 12/2010
JP 2012139329 A * 7/2012
JP 5786474 B2 * 9/2015
JP 2019-129881 A 8/2019
WO WO-2019146344 A1 * 8/2019 ..... D05B 59/00

* cited by examiner

*Primary Examiner* — Ismael Izaguirre
(74) *Attorney, Agent, or Firm* — Nakanishi IP Associates, LLC

(57) ABSTRACT

In the large-diameter bobbin mode of the bobbin winding device, the switching lever is arranged at the switching position, and the interlocking lever is rotated to the blocking position blocking the lowering of the thread trimming holder at the raised position. Therefore, the small-diameter bobbin is arranged above the regular mounting position if it is mounted on the spool shaft. Thus, the engaging hook of the bobbin stopper does not engage with the upper end portion of the core portion of the small-diameter bobbin, and the engaging hook and the thread trimming holder do not sandwich the small-diameter bobbin vertically. Therefore, when the spool shaft is rotated by the spool motor in this state, the bobbin thread is not wound around the small-diameter bobbin since it idles with respect to the spool shaft.

8 Claims, 29 Drawing Sheets

BOBBIN WINDING DEVICE AND SEWING MACHINE

BACKGROUND OF THE INVENTION

1. Field of the Invention

The present invention relates to a bobbin winding device and a sewing machine comprising the bobbin winding device.

2. Description of the Related Art

In the bobbin winding device described in Patent Document 1 below, a pressing member is provided on the bobbin winding shaft, and urged upward by the urging member. When attaching the bobbin to the bobbin winding shaft, the pressing member is pushed down by the bobbin, so that the bobbin is vertically sandwiched between the bobbin winding shaft anti-slip member and the pressing member. As a result, bobbins having different thicknesses (shaft lengths) can be attached to the bobbin winding shaft to wind the bobbin.

The bobbin winding device described in Patent Document 2 below comprises a detecting means for detecting the winding amount of the bobbin and a lever for switching the detection result of the detecting means. By rotating the lever to the first adjustment rotation position or the second adjustment rotation position, the detection result of the detection means is switched. This makes it possible to change the winding amount (winding diameter) of the bobbin thread wound around the bobbin.

RELATED ART DOCUMENTS

Patent Documents

[Patent document 1]
Japanese Patent Application Laid-Open No. 1993-261191
[Patent document 2]
Japanese Patent Application Laid-Open No. 2019-129881

SUMMARY OF THE INVENTION

Disclosure of the Invention

Problem to be Solved by the Invention

Some bobbins have different thicknesses and outer diameters. In this case, by combining the techniques described in Patent Document 1 and Patent Document 2, the bobbin thread can be wound around bobbins with different thicknesses and outer diameters.

However, for example, when the bobbin thread is wound around a bobbin having a small-diameter with the bobbin thread winding amount increased, the bobbin thread may be excessively wound around the bobbin. That is, the winding diameter of the wound bobbin thread may be larger than the outer diameter of the bobbin. In this case, bobbin winding defect with respect to a bobbin occurs.

Considering the above facts, an object of the present invention is to provide a bobbin winding device capable of preventing a bobbin winding defect with respect to a bobbin and a sewing machine comprising the bobbin winding device.

Means to Solve the Problem

At least one embodiment of the present invention proposes a bobbin winding device comprising a spool shaft to which a small-diameter bobbin or a large-diameter bobbin having a larger diameter and a shorter shaft length than the small-diameter bobbin is mounted; an engaging member provided on the spool shaft and having an engaging portion configured to be engageable with the small-diameter bobbin or the large-diameter bobbin mounted on the spool shaft; a holder that is integrally rotatable on the spool shaft and is movable in the axial direction of the spool shaft, and the large-diameter bobbin is sandwiched with the engaging portion in the axial direction of the spool shaft at the first position, and the small-diameter bobbin is sandwiched with the engaging portion in the axial direction of the spool shaft at the second position on the base end side of the spool shaft with respect to the first position; a switch which detects the completion of winding of a bobbin thread around the small-diameter bobbin or the large-diameter bobbin mounted on the spool shaft; a rotating body which is configured to be rotatable around an axis parallel to the spool shaft, and presses the switch by rotating from a non-pressing position separated from the switch to a pressing position via an intermediate position on one side of the rotation direction; a contact portion provided on the rotating body and configured to be able to contact the bobbin thread, and is arranged radially outside the core portion of the small-diameter bobbin or the large-diameter bobbin at the non-pressing position, and rotates the rotating body to one side in the rotation direction by being pressed by the bobbin thread wound around the small-diameter bobbin or the large-diameter bobbin; an urging member that urges the rotating body on the other side in the rotating direction at the non-pressing position and on one side in the rotating direction at the pressing position, and switches the urging direction with respect to the rotating body at the intermediate position; a switching member that is rotatably configured around an axis parallel to the spool shaft and is connected to the urging member, and by rotating from the initial position to the switching position, the intermediate position is changed to one side in the rotation direction of the rotating body, and the bobbin winding mode for the small-diameter bobbin or the large-diameter bobbin is switched from the small-diameter bobbin mode to the large-diameter bobbin mode; and an adjusting member that operates in conjunction with the rotation of the switching member, wherein, in the small-diameter bobbin mode, the small-diameter bobbin is allowed to be mounted at a regular mounting position with respect to the spool shaft; and in the large-diameter bobbin mode, the adjusting member prevents the holder placed in the first position from moving to the second position or moves the holder at the second position to the first position so that the adjusting member prohibits the small-diameter bobbin from being mounted at a regular mounting position with respect to the spool shaft, or prevents the rotation of the holder at the second position.

At least one embodiment of the present invention also proposes a bobbin winding device, comprising a position changing member configured to be movable in conjunction with the rotation of the switching member and to be in contact with the rotating body at the non-pressing position, and in the larger-diameter bobbin mode, the rotating body comes into contact with the position changing member, so that the non-pressing position is changed to one side in the rotation direction of the rotating body.

At least one embodiment of the present invention also proposes a bobbin winding device, wherein in the small-diameter bobbin mode, the adjusting member is arranged at a permitted position away from the holder, and in the larger-diameter bobbin mode, the rotation of the holder is prevented by moving the adjusting member to a blocking position close to the holder and causing the holder at the second position to directly or indirectly contact the adjusting member.

At least one embodiment of the present invention also proposes a bobbin winding device, wherein in the small-diameter bobbin mode, the adjusting member is arranged at a permitted position away from the holder, and in the larger-diameter bobbin mode, the adjusting member moves to a blocking position on the base end side of the spool shaft with respect to the holder, and the direct or indirect contact of the holder with the adjusting member prevents the holder from moving from the first position to the second position.

At least one embodiment of the present invention also proposes a bobbin winding device, wherein a first gear portion is formed on the switching member, and the adjusting member is configured to be rotatable around an axis parallel to the spool shaft, and it is configured to include a second gear portion meshed with the first gear portion and a blocking portion configured so as to be able to directly or indirectly contact the holder.

At least one embodiment of the present invention also proposes a bobbin winding device, wherein the adjusting member connects the switching member and the holder, and configured to be able to switch the position of the holder to the first position or the second position by operating the adjusting member, and in the small-diameter bobbin mode, the holder is arranged at the second position, and in the large-diameter bobbin mode, the holder is moved to the first position by the adjusting member.

At least one embodiment of the present invention also proposes a bobbin winding device, wherein a cam groove is formed in the switching member, and the adjusting member is configured to be rotatable around an axis intersecting the spool shaft, and comprises a cam pin engaged with the cam groove and a connecting portion connected to the holder.

At least one embodiment of the present invention also proposes a sewing machine provided with a bobbin winding device having the above configuration.

Advantage of the Present Invention

According to one or more embodiments of the present invention, it is possible to prevent the bobbin winding defect with respect to a bobbin.

DETAILED DESCRIPTION OF THE INVENTION

First Embodiment

Figure 1:
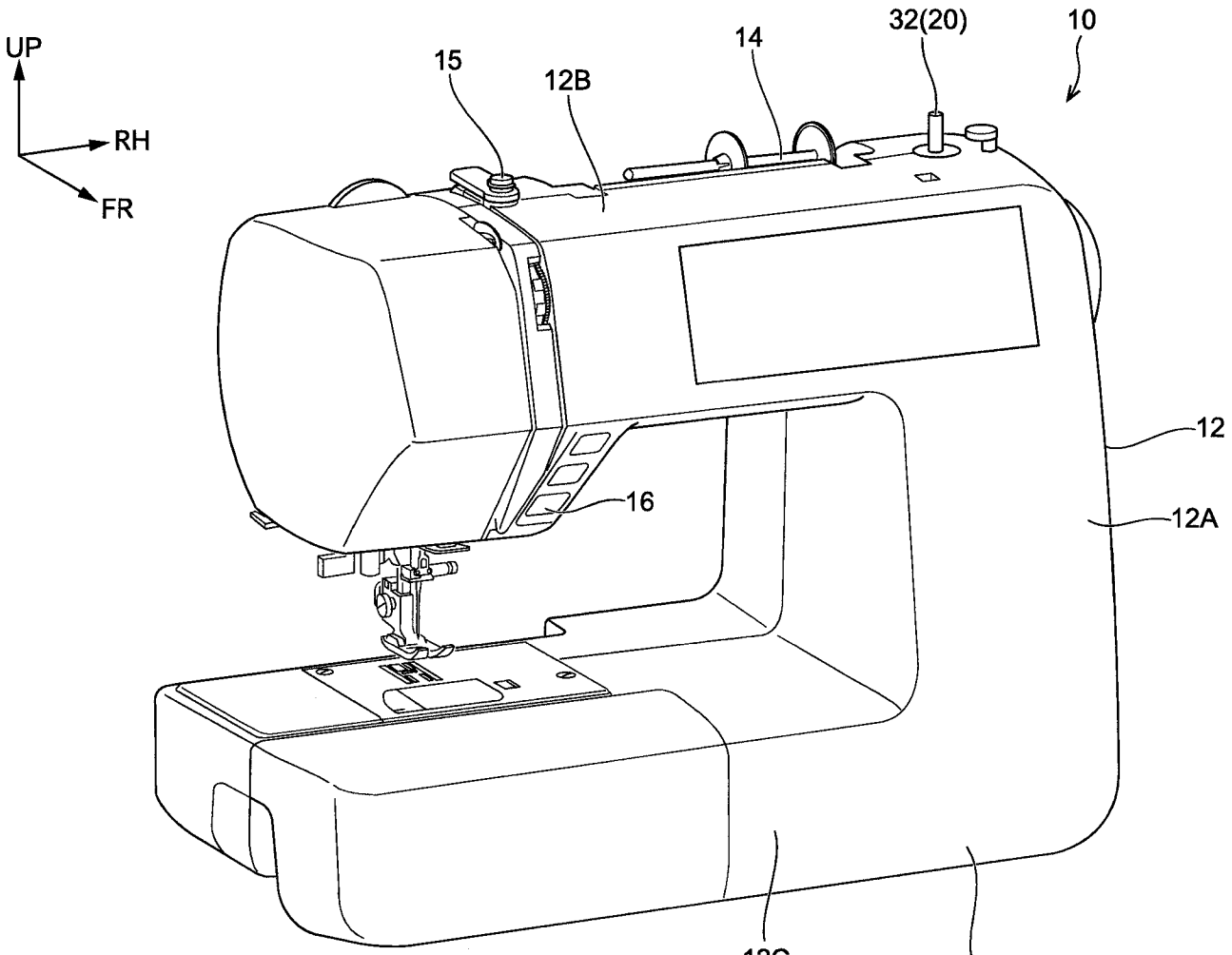
FIG. 1 is a perspective view seen from the diagonally forward left which shows the sewing machine to which the bobbin winding device according to the first embodiment is applied.

Hereinafter, the sewing machine 10 to which the bobbin winding device 20 according to the first embodiment is applied will be described with reference to FIGS. 1 to 11. The arrows UP, FR, and RH appropriately shown in the drawings indicate the upper side, the front side, and the right side (one side in the width direction) of the sewing machine 10 and the bobbin winding device 20, respectively. Hereinafter, when the description is made using the upper-lower, front-back, and left-right directions, it is assumed that they indicate the upper-lower, front-back, and left-right directions of the sewing machine 10 and the bobbin winding device 20.

As shown in FIG. 1, the sewing machine 10 has a sewing machine main body 12, and the sewing machine main body 12 is formed in a roughly U-shape open to the left side when viewed from the front side. Specifically, the sewing machine main body 12 is configured to include a pedestal portion 12A that constitutes the right end portion of the sewing machine body 12 and extends in the upper-lower direction, an arm portion 12B extending to the left from the upper end portion of the pedestal portion 12A, and a bed portion 12C extending to the left from the lower end of the pedestal portion 12A. Further, a skeleton frame (not shown) constituting the skeleton of the sewing machine main body 12 is provided inside the sewing machine main body 12, and the skeleton frame is covered with a cover 13 constituting the outer shell of the sewing machine main body 12.

A bobbin winding device 20 to be described later is built in the right end portion of the arm portion 12B, and the upper end portion of the spool shaft 32 constituting the bobbin winding device 20 projects upward from the arm portion 12B. The arm portion 12B is provided with a thread stand rod 14 diagonally rearward to the left of the spool shaft 32. A thread top (not shown) around which the bobbin thread is wound is attached to the thread stand rod 14.

Further, the arm portion 12B is provided with a spool guide portion 15 on the left side of the thread stand rod 14. The bobbin thread extending from the thread top to the left side is folded back at the spool guide portion 15 and guided to the spool shaft 32 side. Further, an operation button 16 is provided at the left end of the arm portion 12B so that it can be pressed, and a switch (not shown) that is pressed by the pressing operation of the operation button 16 is provided inside the arm portion 12B. The switch is electrically connected to the control unit 70 (see FIG. 4) to output an on/off signal to the control unit 70.

Further, the bobbin winding device 20 of the present embodiment is configured so that the bobbin thread can be wound around two types of bobbins having different forms. Therefore, in the following description, the two types of bobbins will be described, and then the bobbin winding device 20 will be described.

[Configuration of Bobbin]

Figure 2A:
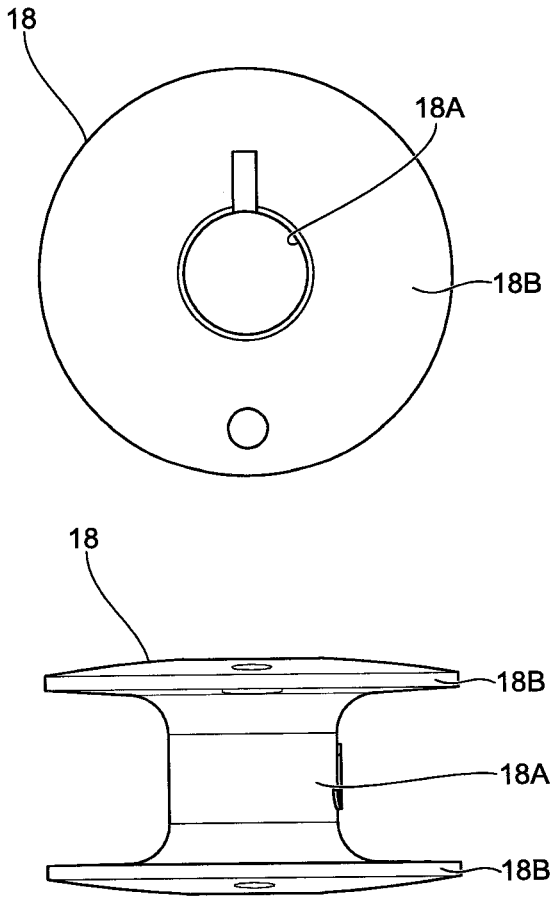
FIG. 2A is a plan view and a side view showing a small-diameter bobbin used in the bobbin winding device according to the first embodiment.
Figure 2B:
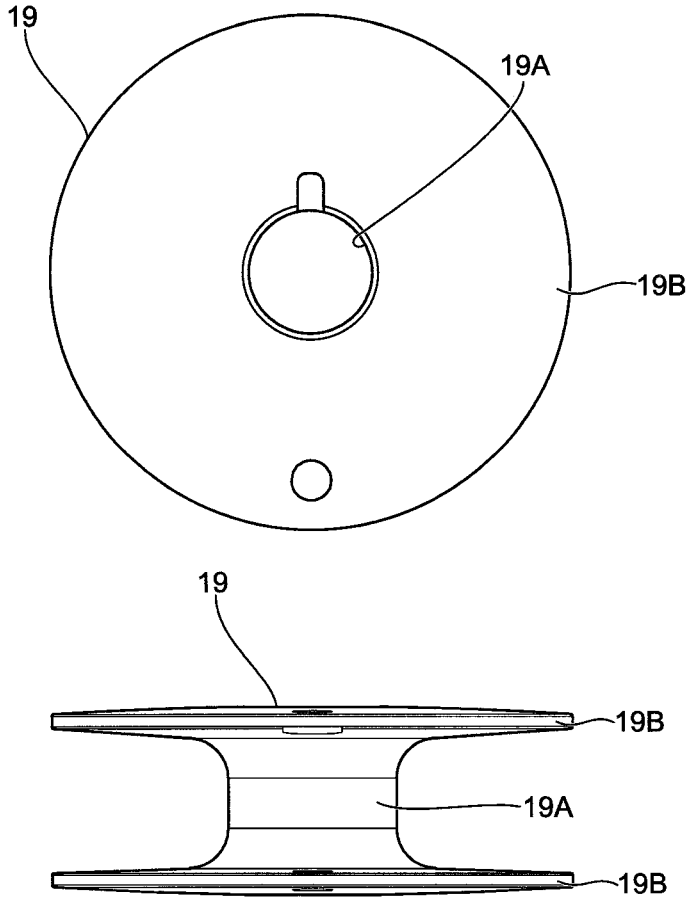
FIG. 2B is a plan view and a side view showing a large-diameter bobbin used in the bobbin winding device according to the first embodiment.

As shown in FIGS. 2A and 2B, the bobbin winding device 20 is configured to enable the use of a small-diameter bobbin 18 and a large-diameter bobbin 19 as two types of "bobbins". The small-diameter bobbin 18 includes a cylindrical core portion 18A and a pair of flange portions 18B protruding outward in the radial direction from both ends in the axial direction of the core portion 18A. Like the small-diameter bobbin 18, the large-diameter bobbin 19 includes a cylindrical core portion 19A and a pair of flange portions 19B protruding outward in the axial direction from both ends in the axial direction of the core portion 19A. The diameter of the flange portion 18B of the small-diameter bobbin 18 is set to be smaller than the diameter of the flange portion 19B of the large-diameter bobbin 19. Further, the thickness dimension (shaft dimension) of the small-diameter bobbin 18 is set to be larger than the thickness dimension of the large-diameter bobbin 19. Therefore, the small-diameter bobbin 18 and the large-diameter bobbin 19 are configured as bobbins having different diameters and thicknesses.

[Configuration of Bobbin Winding Device 20]

Figure 3:
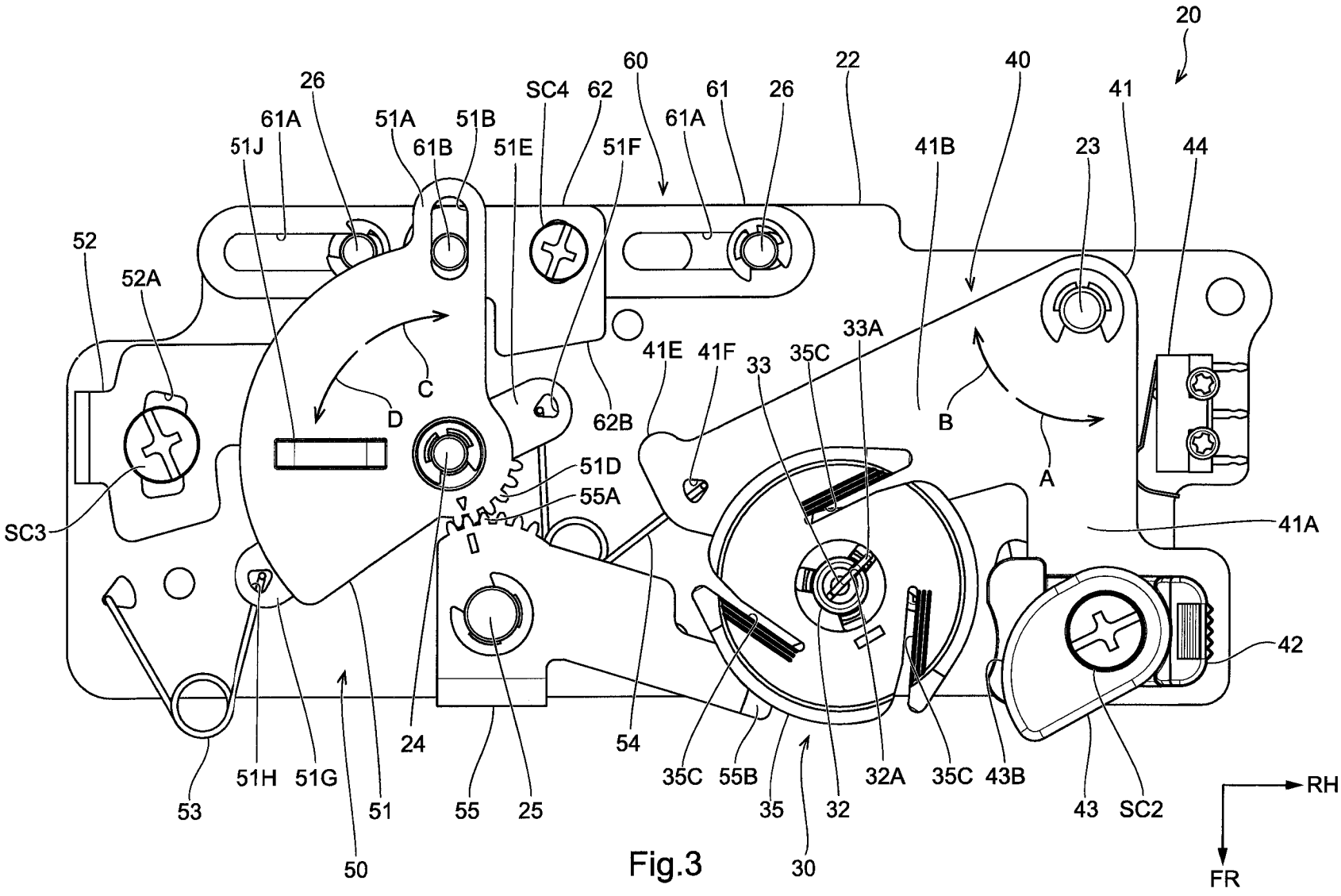
FIG. 3 is a plan view seen from the upper side of the bobbin winding device according to the first embodiment.
Figure 4:
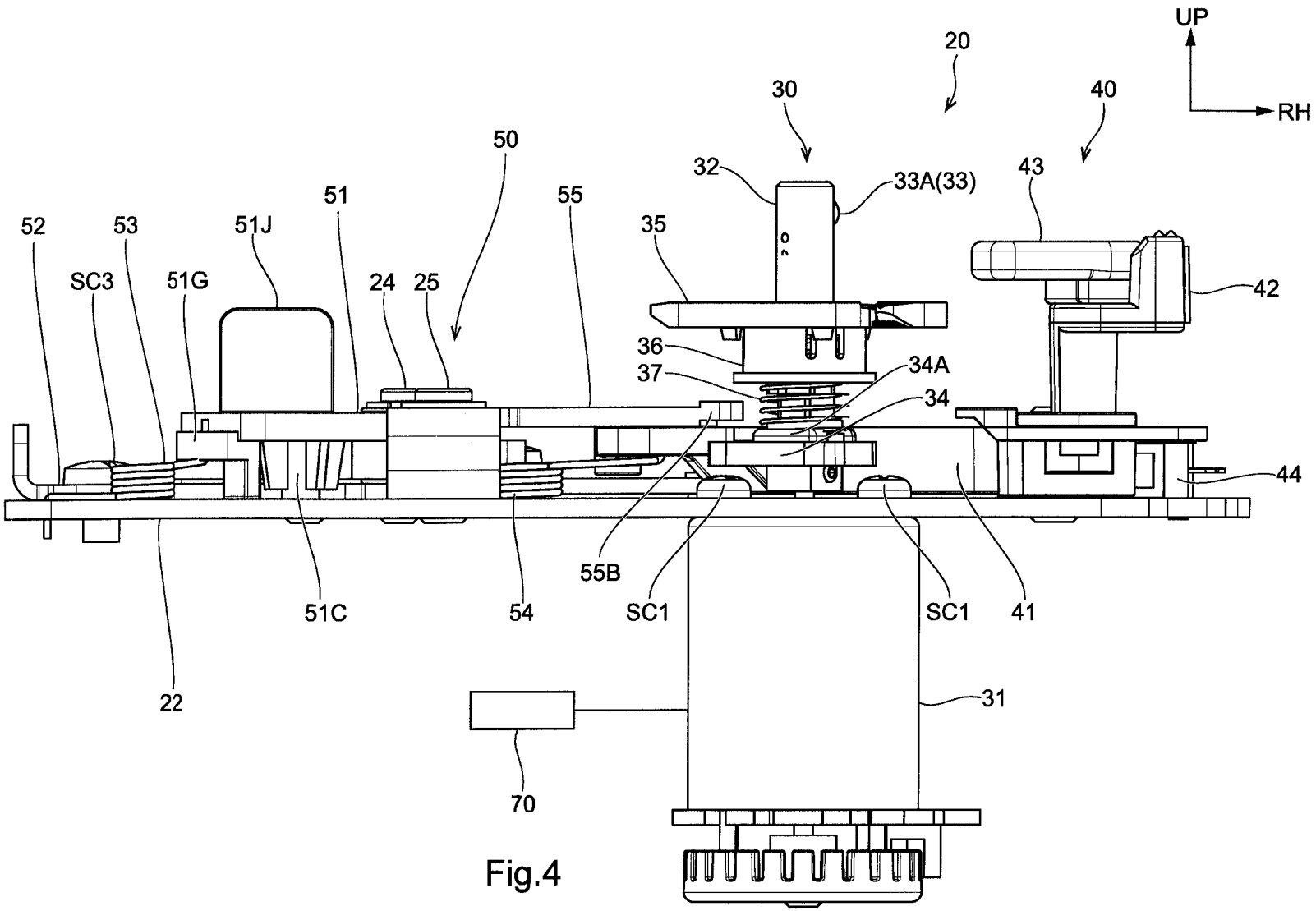
FIG. 4 is a front view seen from the front side of the bobbin winding device shown in FIG. 3.
Figure 5:
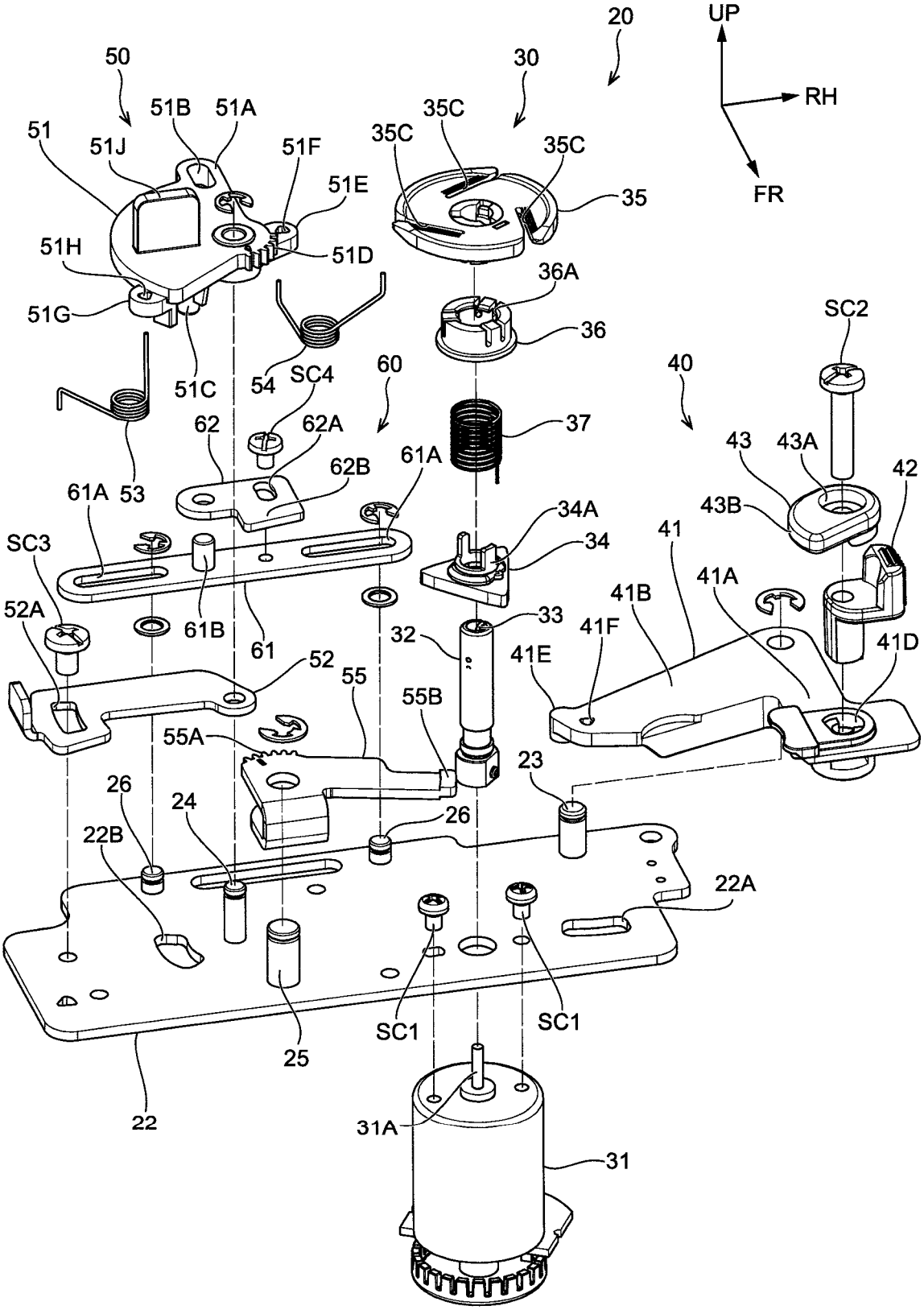
FIG. 5 is an exploded perspective view of the bobbin winding device shown in FIG. 3.

As shown in FIGS. 3 to 5, the bobbin winding device 20 includes a base plate 22, a bobbin winding mechanism unit 30, a bobbin winding detection mechanism unit 40, switching mechanism unit 50, and position adjusting mechanism unit 60. Hereinafter, each configuration of the bobbin winding device 20 will be described.

[Configuration of Base Plate 22]

The base plate 22 is formed in a roughly rectangular plate shape with the upper-lower direction as the plate thickness direction and the left-right direction as the longitudinal direction. The base plate 22 is built in the right end of the arm portion 12B of the sewing machine main body 12, and is fixed to the skeleton frame of the sewing machine main body 12.

[Configuration of Bobbin Winding Mechanism Unit 30]

As also shown in FIG. 6, the bobbin winding mechanism unit 30 includes a spool motor 31, a spool shaft 32, a triangular cam 34, a thread trimming holder 35 as a "holder", a holder stopper 36, and a holder urging spring 37 as a "holder urging member".

The spool motor 31 has an axial direction in the upper-lower direction and arranged below the base plate 22, and is fastened and fixed to the base plate 22 by screws SC1. The output shaft 31A of the spool motor 31 projects upward from the base plate 22.

The spool shaft 32 is formed in a roughly cylindrical shape with the upper-lower direction as the axial direction. And the upper end of the output shaft 31A of the spool motor 31 is fitted into the lower end of the spool shaft 32, and the spool shaft 32 is integrally rotatably connected to the output shaft 31A. A bobbin stopper 33 (see FIGS. 6A and 6B) as an "engaging member" is provided inside the upper portion of the spool shaft 32. The bobbin stopper 33 is configured as a bar spring and is bent in a roughly U-shape open upward in a side view. One end of the bobbin stopper 33 is locked to the spool shaft 32, and the other end of the bobbin stopper 33 is arranged in the slit 32A formed on the spool shaft 32. As a result, the bobbin stopper 33 is configured to be elastically deformable in the radial direction of the spool shaft 32. An engaging hook 33A as an "engaging portion" is formed at the other end of the bobbin stopper 33. The engaging hook 33A is bent in a roughly U shape and protrudes outward from the slit 32A in the radial direction of the spool shaft 32.

The triangular cam 34 is formed in a roughly triangular plate shape with the upper-lower direction as the plate thickness direction. A mounting cylinder portion 34A is formed at a roughly central portion of the triangular cam 34, and the mounting cylinder portion 34A is formed in a cylindrical shape with the upper-lower direction as the axial direction. The mounting cylinder portion 34A projects upward from the triangular cam 34, and the inside of the mounting cylinder portion 34A penetrates in the upper-lower direction. And the lower end portion of the spool shaft 32 is fitted into the mounting cylinder portion 34A, and the triangular cam 34 is integrally rotatably connected to the lower end portion of the spool shaft 32.

The thread trimming holder 35 is formed in a roughly disk shape with the upper-lower direction as the plate thickness direction. A mounting portion 35A projecting downward is formed in the central portion of the thread trimming holder 35, and the mounting portion 35A is formed in a roughly cylindrical shape with the upper-lower direction as the axial direction. The spool shaft 32 is inserted into the mounting portion 35A of the thread trimming holder 35, and the thread trimming holder 35 is arranged below the engaging hook 33A of the bobbin stopper 33 (one side of the spool shaft 32 in the axial direction [base end side]) and above the triangular cam 34. Further, the mounting portion 35A is connected to the spool shaft 32 so as to be integrally rotatable and relatively movable in the axial direction. Specifically, the thread trimming holder 35 is configured to be movable between a raised position as a "first position" (the position shown in FIG. 6B) and a lowered position as a "second position" (the position shown in FIG. 6A) lowered from the raised position. Further, a hook portion 35B (see FIGS. 6A and 6B) is formed at the lower end portion of the mounting portion 35A, and the hook portion 35B engages with the spool shaft 32 to restrict the movement of the thread trimming holder 35 to the upper side in the raised position. Further, three thread trimming slits 35C are formed on the outer peripheral portion of the thread trimming holder 35.

The holder stopper 36 is formed in a roughly bottomed cylindrical shape that is open downward. An insertion hole 36A is formed through the upper wall of the holder stopper 36. With the spool shaft 32 inserted into the insertion hole 36A, the holder stopper 36 is arranged on the outer side in the radial direction of the mounting portion 35A of the thread trimming holder 35. Further, the upper end portion of the holder stopper 36 is fixed to the mounting portion 35A of the thread trimming holder 35 by claw fitting. As a result, the thread trimming holder 35 and the holder stopper 36 are connected so as to be integrally movable.

The holder urging spring 37 is configured as a compression coil spring. The holder urging spring 37 is mounted on the mounting cylinder portion 34A of the triangular cam 34 and the mounting portion 35A of the thread trimming holder 35 in a state of being housed in the holder stopper 36. Specifically, the lower end of the holder urging spring 37 is locked to the triangular cam 34, and the upper end of the holder urging spring 37 is locked to the upper wall of the holder stopper 36. As a result, the holder stopper 36 is held in the raised position by the upward urging force of the holder urging spring 37.

Figure 6A:
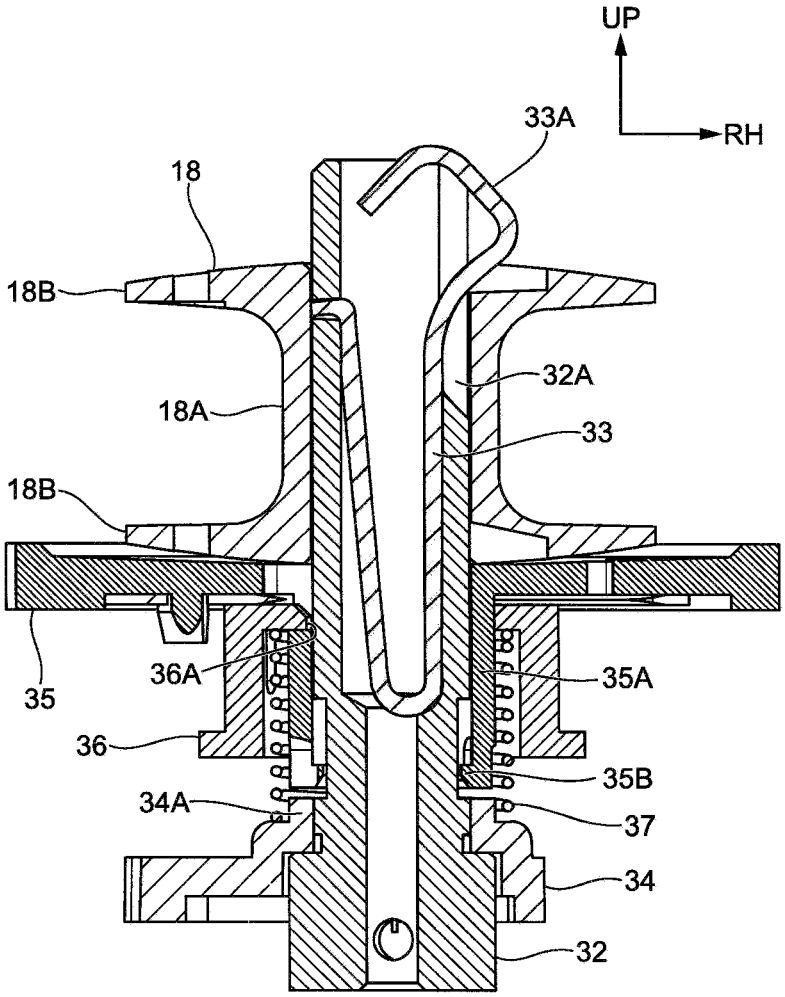
FIG. 6A is a vertical cross-sectional view showing a state in which a small-diameter bobbin is attached to the upper end of the spool shaft shown in FIG. 3.

Further, in the mounted state of the small-diameter bobbin 18 on the spool shaft 32, the spool shaft 32 is inserted into the core portion 18A of the small-diameter bobbin 18, and the small-diameter bobbin 18 is arranged adjacent to the upper side of the thread trimming holder 35 in the lowered position, and the engaging hook 33A of the bobbin stopper 33 engages with the upper end of the core portion 18A of the small-diameter bobbin 18 (see FIG. 6A). On the other hand, in the mounted state of the large-diameter bobbin 19 on the spool shaft 32, the spool shaft 32 is inserted into the core portion 19A of the large-diameter bobbin 19, and the large-diameter bobbin 19 is arranged adjacent to the upper side of the thread trimming holder 35 in the raised position. At the same time, the engaging hook 33A of the bobbin stopper 33 engages with the upper end portion of the core portion 19A of the large-diameter bobbin 19 (see FIG. 6B). As a result, the engaging hook 33A and the thread trimming holder 35 holds the small-diameter bobbin 18 and the large-diameter bobbin 19 mounted on the spool shaft 32 by sandwiching them in the upper-lower direction. Therefore, when the spool shaft 32 rotates, the small-diameter bobbin 18 and the large-diameter bobbin 19 are prevented from idling, and the small-diameter bobbin 18 and the large-diameter bobbin 19 rotate together with the spool shaft 32.

[Configuration of Bobbin Winding Detection Mechanism Unit 40]

As shown in FIGS. 3 to 5, the bobbin winding detection mechanism unit 40 includes a detection lever 41 as a "rotating body", a lever operation portion 42, a lever contact 43 as a "contact portion", and a detection switch 44 as a "switch".

<Configuration of Detection Lever 41>

The detection lever 41 is formed in a roughly V-shaped plate shape with the upper-lower direction as the plate thickness direction. Specifically, detection lever 41 is configured to include a first lever arm 41A extending roughly in the front-rear direction, a second lever arm 41B extending diagonally forward to the left from the rear end portion of the first lever arm 41A. The detection lever 41 is arranged on the upper side of the base plate 22 and diagonally to the right rear side of the bobbin winding mechanism unit 30 so that the bobbin winding mechanism unit 30 is arranged between the first lever arm 41A and the second lever arm 41B. Further, the rear end portion of the first lever arm 41A of the detection lever 41 is rotatably supported by the first shaft 23, and the first shaft 23 is formed in a roughly cylindrical shape with the upper-lower direction as the axial direction and protrudes upward from the base plate 22.

Figure 7:
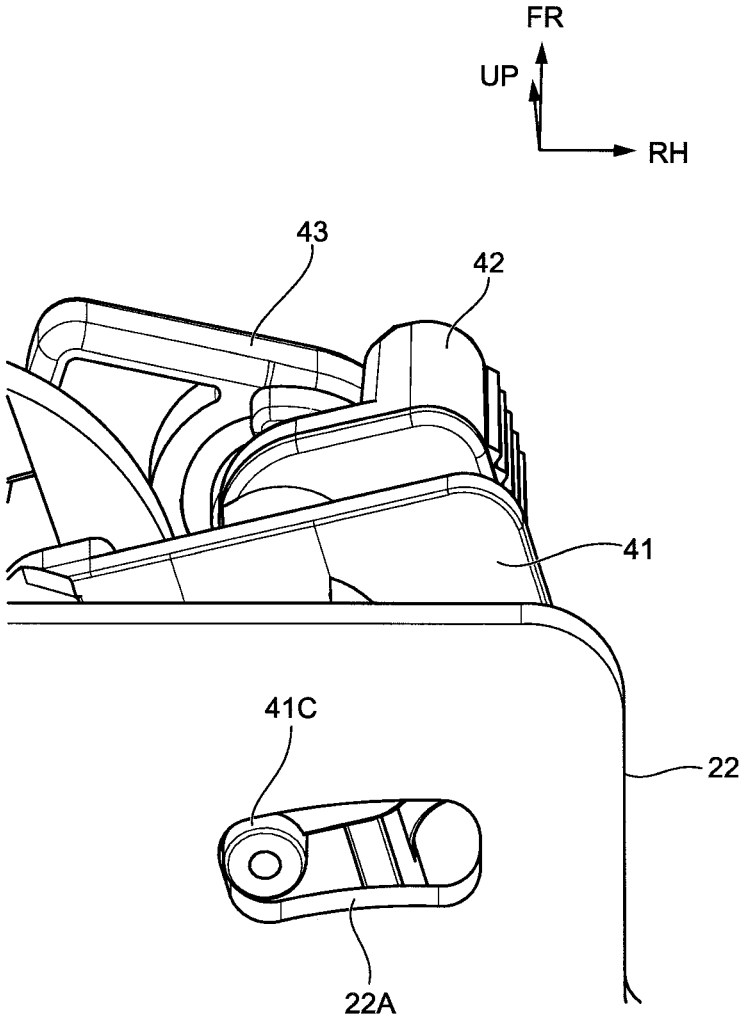
FIG. 7 is a perspective view seen from below showing a state in which the regulation pin of the detection lever shown in FIG. 5 is inserted into the regulation hole of the base plate.

As shown in FIG. 7, a regulation pin 41C is provided at the front end portion of the first lever arm 41A. The regulation pin 41C is formed in a roughly columnar shape and protrudes downward from the first lever arm 41A. The regulation pin 41C is inserted into the regulation hole 22A formed in the base plate 22 so as to be relatively movable. The regulation hole 22A is formed in an oblong hole shape and extends along the rotation direction of the detection lever 41. As a result, the rotation range of the detection lever 41 is regulated by the regulation hole 22A. Specifically, the detection lever 41 is configured to be rotatable between the non-pressing position (position shown in FIG. 8A) and the pressing position (position shown in FIG. 3) rotated from the non-pressing position to one side in the rotation direction (arrow A direction side in FIG. 8A).

As shown in FIG. 5, a fitting hole 41D into which a lever operation portion 42, which will be described later, is fitted is formed in the front end portion of the first lever arm 41A. Further, as shown in FIG. 3, a lever protrusion 41E is provided at the tip of the second lever arm 41B. The lever protrusion 41E is formed in a roughly semicircular shape in a plan view, and protrudes from the tip end portion of the second lever arm 41B toward the other direction in the rotation direction of the detection lever 41 (the side in the direction of arrow B in FIG. 3). Further, a locking hole 41F for locking the switching spring 54, which will be described later, is formed through the tip of the second lever arm 41B.

<Configuration of Lever Operation Portion 42>

The lever operating portion 42 is formed in a roughly crank shape when viewed from the front side. The lower portion of the lever operating portion 42 is fitted into the fitting hole 41D of the detection lever 41, and the lever operating portion 42 is fixed to the detection lever 41. Further, the lower portion of the lever operating portion 42 is formed in a tubular shape, and a female screw is formed on the inner peripheral surface of the lower portion of the lever operating portion 42.

<Configuration of Lever Contact 43>

The lever contact 43 is formed in a roughly elliptical plate shape with the upper-lower direction as the plate thickness direction, and is arranged on the upper side of the lower portion of the lever operating portion 42. A fixing hole 43A is formed through one end of the lever contact 43. The screw SC2 is inserted into the fixing hole 43A and screwed into the female screw of the lever operating portion 42, and the lever contact 43 is fixed to the lever operating portion 42 by the screw SC2. As a result, the lever contact 43 is configured to be integrally rotatable with the detection lever 41, and is arranged on one side in the rotation direction of the detection lever 41 with respect to the spool shaft 32.

A contact portion 43B is formed at the other end of the lever contact 43, and the contact portion 43B is curved in an arc shape that is convex toward the other side in the rotation direction of the detection lever 41 in a plan view. The contact portion 43B and the spool shaft 32 are arranged so as to face each other with a predetermined interval in the rotation direction of the detection lever 41.

At the non-pressing position of the detection lever 41, a part of the contact portion 43B of the lever contact 43 is inserted into the small-diameter bobbin 18 and the large-diameter bobbin 19 mounted on the spool shaft 32. On the other hand, at the pressing position of the detection lever 41, the large-diameter bobbin 19 mounted on the spool shaft 32 and the lever contact 43 are set so as not to overlap in a plan view. That is, at the pressing position of the detection lever 41, the small-diameter bobbin 18 and the large-diameter bobbin 19 and the lever contact 43 do not interfere with each other when the small-diameter bobbin 18 and the large-diameter bobbin 19 are attached/detached. Further, as will be described in detail later, when the bobbin thread is wound around the small-diameter bobbin 18 and the large-diameter bobbin 19, the wound bobbin thread abuts on the contact portion 43B and presses the contact portion 43B to one side in the rotation direction of the detection lever 41.

<Configuration of Detection Switch 44>

As shown in FIGS. 3 and 8, the detection switch 44 is arranged on the right side of the detection lever 41 and fixed to the base plate 22. The detection switch 44 is configured as a lever type switch. It is configured that at the non-pressed position of the detection lever 41, the lever portion of the detection switch 44 is in the non-pressed state, and at the pressed position of the detection lever 41, the lever portion of the detection switch 44 is pressed by the detection lever 41. Further, the detection switch 44 is electrically connected to the control unit 70, and outputs an on/off signal to the control unit 70.

[Configuration of Switching Mechanism Unit 50]

As shown in FIGS. 3 to 5, the switching mechanism unit 50 includes a switching lever 51 as a "switching member", a lever stopper 52, a lever urging spring 53, a switching spring 54 as the "urging member", and an interlocking lever 55 as the "adjusting member".

<Configuration of Switching Lever 51>

The switching lever 51 is formed in a roughly fan-shaped plate shape with the upper-lower direction as the plate thickness direction, and is arranged on the left side of the bobbin winding mechanism unit 30 and the detection lever 41. The switching lever 51 is rotatably supported by the second shaft 24, and the second shaft 24 is formed in a columnar shape with the upper-lower direction as the axial direction, which projects upward from the base plate 22. The tip portion of the switching lever 51 is formed in an arc shape that is convex diagonally to the left and rearward in a plan view. A protruding portion 51A is formed at end of the tip portion of the switching lever 51 in the one side in the rotation direction (arrow C direction side in FIG. 3), and the protruding portion 51A projects outward in the radial direction of the switching lever 51. Further, a connecting hole 51B is formed through the protruding portion 51A, and the connecting hole 51B is formed in an oblong hole shape with the radial direction of the switching lever 51 as the longitudinal direction.

A regulation pin 51C is provided at the end of the switching lever 51 on the other side in the rotation direction (the side in the direction of arrow D in FIG. 3). The regulation pin 51C is formed in a roughly cylindrical shape and protrudes downward from the switching lever 51. The regulation pin 51C is inserted into the regulation hole 22B (see FIG. 5) formed in the base plate 22 so as to be relatively movable. The regulation hole 22B is formed in an oblong hole shape and extends along the rotation direction of the switching lever 51. Further, the regulation pin 51C is configured so as to be able to come into contact with the inner peripheral surface of one end of the regulation hole 22B or the outer peripheral surface of the lever stopper 52 described later. Specifically, when the regulation pin 51C comes into contact with the inner peripheral surface of one end of the regulation hole 22B, the switching lever 51 is arranged at the initial position shown in FIG. 3. When the switching lever 51 is rotated from the initial position to the switching position rotated to one side in the rotation direction (position shown in FIG. 9), the regulation pin 51C is configured to come into contact with the outer peripheral portion of the lever stopper 52.

A switching gear portion 51D as a "first gear portion" is formed on the outer peripheral portion of the switching lever 51. The switching gear portion 51D is composed of a plurality of gear teeth, and the plurality of gear teeth are arranged side by side along the circumferential direction of the second shaft 24. The switching lever 51 has a first locking portion 51E for locking the end portion of the switching spring 54, which will be described later. The first locking portion 51E projects obliquely rearward to the right from the switching lever 51. A first locking hole 51F is formed through the tip of the first locking portion 51E. A second locking portion 51G for locking the lever urging spring 53, which will be described later, is provided at the tip of the switching lever 51 in the other end of the rotation direction, and the second locking portion 51G projects radially outward from the switching lever 51. A second locking hole 51H is formed through the second locking portion 51G.

A handle portion 51J is formed on the upper surface of the switching lever 51 on the left side of the second shaft 24. The handle portion 51J is formed in a roughly plate shape with the front-rear direction as the plate thickness direction, and extends upward from the switching lever 51. Further, the switching lever 51 is configured as a member for switching between a small-diameter bobbin mode in which the bobbin is wound around the small-diameter bobbin 18 by the bobbin winding device 20 and a large-diameter bobbin mode in which the bobbin is wound around the large-diameter bobbin 19 by the bobbin winding device 20. Specifically, the bobbin winding device 20 is set to the small-diameter bobbin mode at the initial position of the switching lever 51, and the bobbin winding device 20 is set to the large-diameter bobbin mode at the switching position of the switching lever 51.

<Configuration of Lever Stopper 52>

The lever stopper 52 is formed in a roughly rectangular plate shape having a plate thickness in the upper-lower direction and a longitudinal direction in the left-right direction, and is arranged between the base plate 22 and the switching lever 51. The right end of the lever stopper 52 is rotatably supported by the second shaft 24. A fixing hole 52A is formed through the left end of the lever stopper 52, and the fixing hole 52A is formed in an oblong hole shape with the rotation direction of the lever stopper 52 as the longitudinal direction. The lever stopper 52 is fastened and fixed to the base plate 22 by the screw SC3 inserted in the fixing hole 52A.

Further, in the fixed state of the lever stopper 52 to the base plate 22, the outer peripheral portion of the base plate 22 is arranged so as to close the other end of the regulation hole 22B of the base plate 22. As a result, the regulation pin 51C is configured to come into contact with the outer peripheral portion of the lever stopper 52 at the switching position of the switching lever 51. Further, as described above, the fixing hole 52A is formed in an oblong hole shape in which the rotation direction of the lever stopper 52 is the longitudinal direction. Therefore, the fixed position of the lever stopper 52 is changed so that the switching position of the switching lever 51 can be adjusted as appropriate.

<Configuration of Lever Urging Spring 53>

The lever urging spring 53 is configured as a torsion spring. One end of the lever urging spring 53 is locked to the base plate 22, and the other end of the lever urging spring 53 is inserted into the second locking hole 51H of the switching lever 51 and locked to the second locking portion 51G. At the initial position of the switching lever 51, the lever urging spring 53 urges the switching lever 51 to the other side in the rotation direction. As a result, the regulation pin 51C of the switching lever 51 comes into contact with one end of the regulation hole 22B of the base plate 22, and the switching lever 51 is held in the initial position. On the other hand, at the switching position of the switching lever 51, the lever urging spring 53 urges the switching lever 51 to one side in the rotation direction. As a result, the regulation pin 51C of the switching lever 51 comes into contact with the outer peripheral portion of the lever stopper 52, and the switching lever 51 is held at the switching position. When switching the position of the switching lever 51, the user grips the handle portion 51J of the switching lever 51 to rotate the switching lever 51.

<Configuration of Switching Spring 54>

The switching spring 54 is configured as a torsion spring. One end of the switching spring 54 is inserted into the first locking hole 51F of the switching lever 51 and locked to the first locking portion 51E, and the other end of the switching spring 54 is inserted into the locking hole 41F of the detection lever 41 and locked to the tip portion of the second lever arm 41B. The switching spring 54 urges the detection lever 41 in the rotation direction. Specifically, the switching spring 54 is configured to urge the detection lever 41 to the other side in the rotation direction at the non-pressing position of the detection lever 41, and to urge the detection lever 41 to one side in the rotation direction at the pressing position of the detection lever 41. That is, it is configured that the urging direction of the switching spring 54 with respect to the detection lever 41 is switched at an intermediate position (position shown in FIG. 8B) between the non-pressing position and the pressing position of the detection lever 41.

Figure 9:
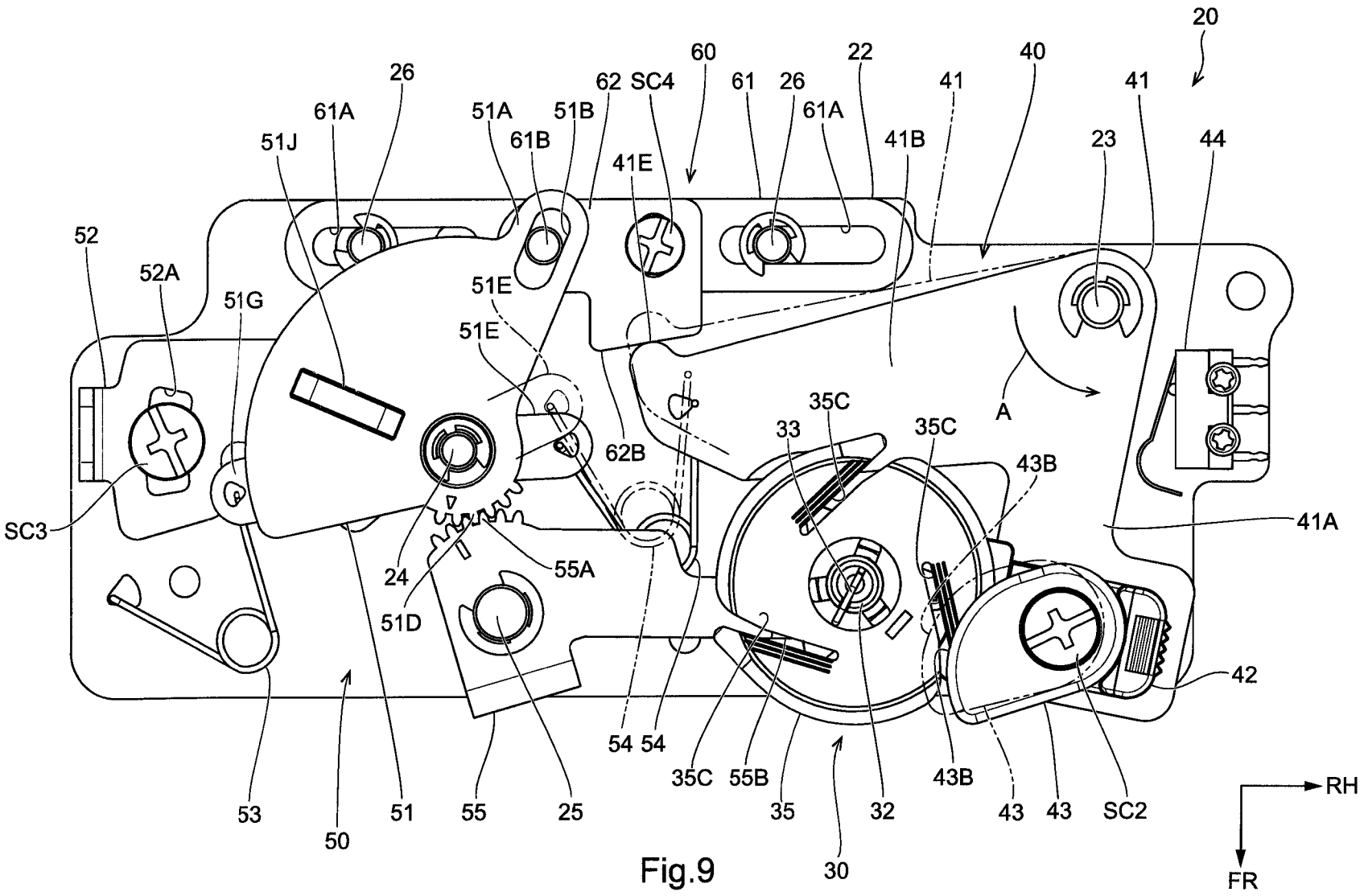
FIG. 9 is a plan view showing a state in which the non-pressed position of the detection lever is changed when the switching lever shown in FIG. 8A is rotated to the switching position.
Figure 10:
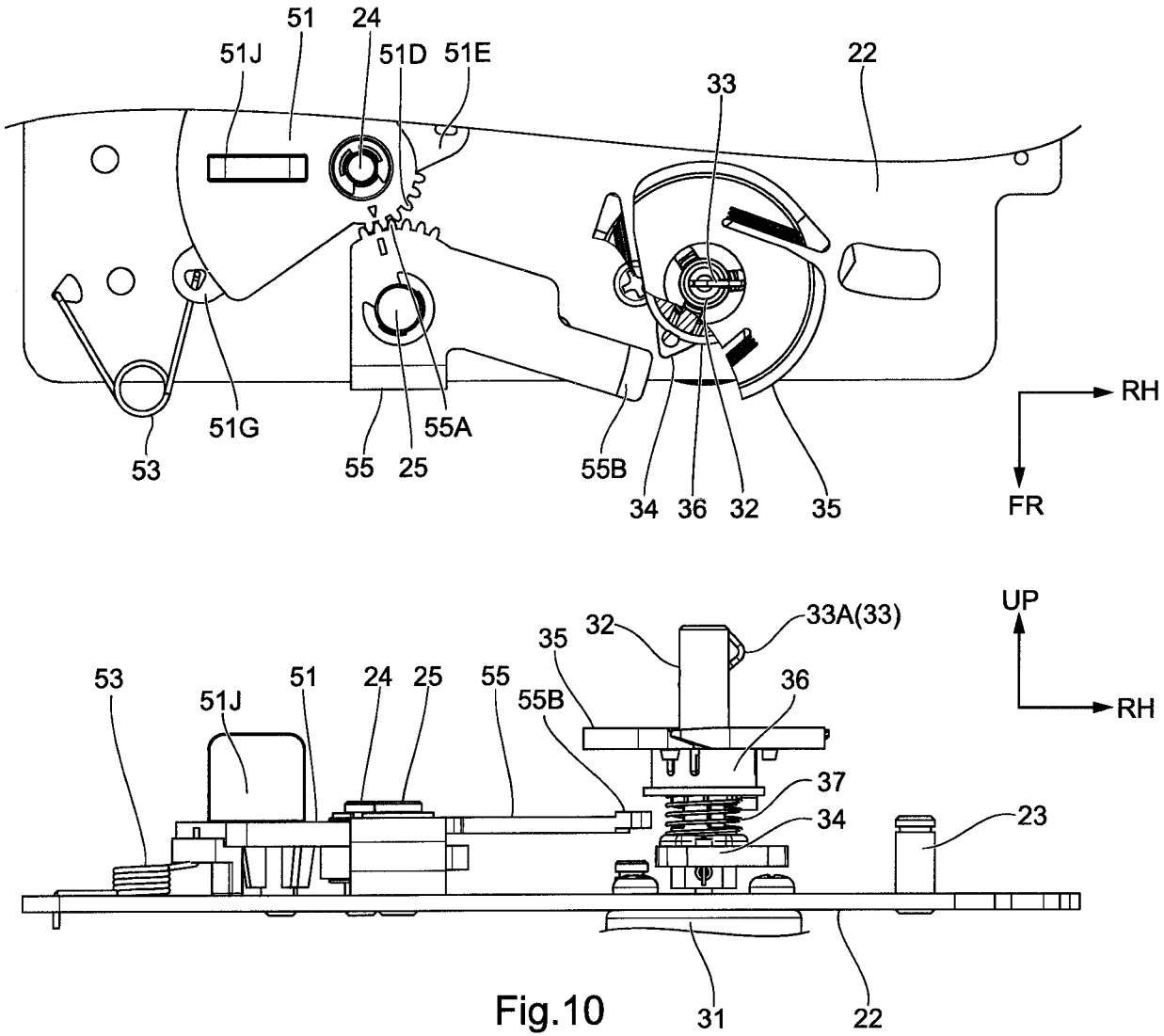
FIG. 10 is explanatory drawing for demonstrating the positional relationship between the interlocking lever and the holder stopper in the small-diameter bobbin mode.
Figure 11:
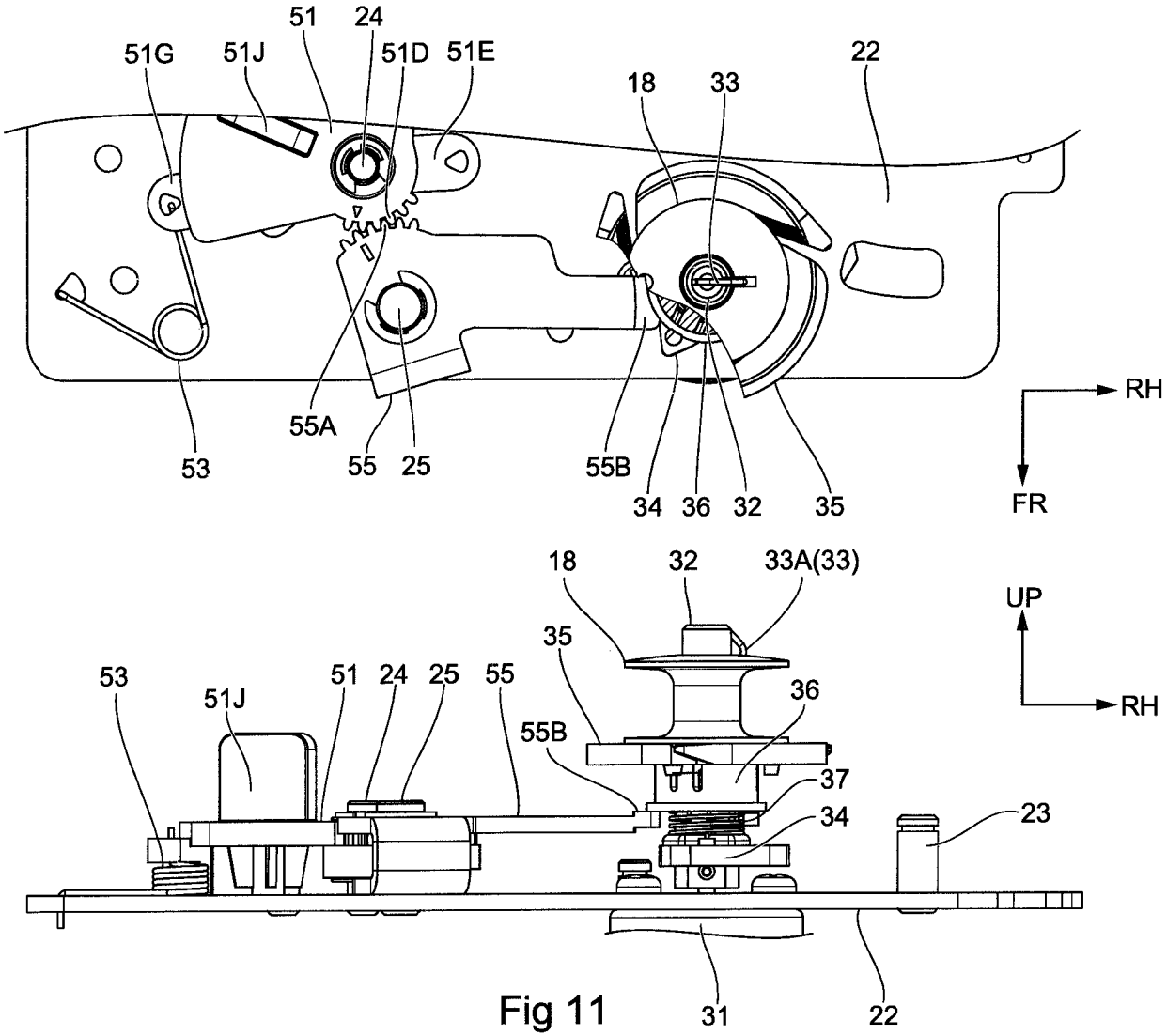
FIG. 11 is explanatory drawing for demonstrating the state in which the small-diameter bobbin is attached to the spool shaft in the large-diameter bobbin mode.

Further, as shown in FIG. 9, when the switching lever 51 rotates from the initial position to the switching position, one end of the switching spring 54 is displaced to one side in the rotation direction of the switching lever 51. For this reason, the entire switching spring 54 is displaced to one side in the rotation direction of the detection lever 41. Therefore, in the large-diameter bobbin mode of the bobbin winding device 20, the intermediate position of the detection lever 41 is changed to one side in the rotation direction of the detection lever 41 as compared with the small-diameter bobbin mode of the bobbin winding device 20.

<Configuration of Interlocking Lever 55>

As shown in FIGS. 3 to 5, the interlocking lever 55 is formed in a roughly long plate shape with the upper-lower direction as the plate thickness direction and extending in the left-right direction. The left end of the interlocking lever 55 is bent into a roughly U shape that is open to the rear when viewed from the left side. Specifically, the front end portion of the left end portion of the interlocking lever 55 is bent downward and backward. The left end portion of the interlocking lever 55 is rotatably supported by a third shaft 25 provided on the base plate 22 on the front side of the second shaft 24, and the third shaft 25 is formed in a roughly columnar shape with the upper-lower direction as the axial direction, and projects upward from the base plate 22.

An interlocking gear portion 55A as a "second gear portion" is formed on the outer peripheral portion of the left end portion of the interlocking lever 55. The interlocking gear portion 55A is composed of a plurality of gear teeth, and the plurality of gear teeth are arranged side by side in the circumferential direction of the third shaft 25. The interlocking gear portion 55A is engaged with the switching gear portion 51D of the switching lever 51. As a result, the interlocking lever 55 is configured to rotate in conjunction with the rotation of the switching lever 51. At the initial position of the switching lever 51, the interlocking lever 55 is arranged at the permitted position (position shown in FIG. 10), and at the switching position of the switching lever 51, the interlocking lever 55 is arranged at the blocking position (position shown in FIG. 11).

Further, the right end portion of the interlocking lever 55 is configured as a blocking portion 55B, and the blocking portion 55B is arranged close to the lower side of the holder stopper 36 of the bobbin winding mechanism unit 30. Specifically, at the permitted position of the interlocking lever 55, the blocking portion 55B is set at a position where it does not overlap the holder stopper 36 in a plan view (see FIG. 10), and at the blocking position of the interlocking lever 55, the blocking portion 55B is set so as to approach the holder stopper 36 and be arranged at a position overlapping the holder stopper 36 in a plan view (see FIG. 11). As a result, at the permitted position of the interlocking lever 55, the thread trimming holder 35 is set to be permitted to move from the raised position to the lowered position, and at the blocking position of the interlocking lever 55, the blocking portion 55B of the holder stopper 36 is set to prevent the thread trimming holder 35 from moving to the lowered position. Further, the holder stopper 36 comes into contact with the blocking portion 55B, so that the rotation of the spool shaft 32 is restricted.

[Configuration of Position Adjusting Mechanism Unit 60]

As shown in FIGS. 3, 5, 8, and 9, the position adjusting mechanism unit 60 includes a slide member 61 and an adjusting plate 62. The slide member 61 and the adjusting plate 62 correspond to the "position changing member" of the present invention.

The slide member 61 is formed in a roughly long plate shape having an upper-lower direction as a plate thickness direction and extending in the left-right direction. A pair of slide holes 61A are formed through the slide member 61 at both ends in the longitudinal direction, and the slide holes 61A are formed in an oblong hole shape with the left-right direction as the longitudinal direction. A support pin 26 provided on the base plate 22 is inserted into the slide hole 61A, and the slide member 61 is slidably connected to the base plate 22 in the left-right direction.

A connecting pin 61B is provided at the intermediate portion in the longitudinal direction of the slide member 61. The connecting pin 61B is formed in a roughly columnar shape with the upper-lower direction as the axial direction, and projects upward from the slide member 61. The connecting pin 61B is inserted into the connecting hole 51B of the switching lever 51 described above so as to be relatively movable. As a result, it is configured that the slide member 61 is connected to the switching lever 51 and slides in the left-right direction in conjunction with the rotation of the switching lever 51.

The adjusting plate 62 is formed in a roughly inverted L-shaped plate shape with the upper-lower direction as the plate thickness direction. Specifically, the adjustment plate extends in the left-right direction, and the right end portion of the adjustment plate 62 projects forward. The adjusting plate 62 is arranged on the upper side of the slide member 61, and the left end portion of the adjusting plate 62 is rotatably supported by the connecting pin 61B. A fixing hole 62A is formed through the right end portion of the adjusting plate 62, and the fixing hole 62A is formed in an oblong hole shape with the rotation direction of the adjusting plate 62 as the longitudinal direction. The adjusting plate 62 is fastened and fixed to the slide member 61 by the screw SC4 inserted through the fixing hole 62A.

The portion of the right end of the adjustment plate 62 that protrudes to the front side is configured as the adjustment portion 62B, and the front end portion of the adjustment portion 62B is inclined to the rear side toward the right side. At the initial position of the switching lever 51, the adjusting plate 62 is separately arranged diagonally to the left and rearward of the second lever arm 41B of the detection lever 41 at the non-pressing position (see FIG. 8A). On the other hand, at the switching position of the switching lever 51, the adjusting portion 62B of the adjusting plate 62 is configured to slide to the rear side of the lever protrusion 41E of the detection lever 41 in the non-pressing position to press the lever protrusion 41E to the front side (see FIG. 9). As a result, it is configured that the position adjusting mechanism unit 60 changes the non-pressing position of the detection lever 41 in the large-diameter bobbin mode (positions shown by solid lines in FIG. 9) to one side in the rotation direction of the detection lever 41 as compared with the non-pressing position of the detection lever 41 in the small-diameter bobbin mode (positions shown by the two-dot chain line in FIG. 9).

[Operation Effect]

Next, the procedure for mounting the small-diameter bobbin 18 on the spool shaft 32 and the operation of the bobbin winding device 20 in the small-diameter bobbin mode of the bobbin winding device 20 will be described. Then the procedure for mounting the large-diameter bobbin 19 on the spool shaft 32 and the operation of the bobbin winding device 20 in the large-diameter bobbin mode of the bobbin winding device 20 will be described, and the operations and effects of the first embodiment will be described.

[Configuration of Small-Diameter Bobbin Mode of Bobbin Winding Device 20]

As shown in FIG. 3, in the small-diameter bobbin mode of the bobbin winding device 20, the switching lever 51 is arranged at the initial position and the interlocking lever 55 is arranged at the permitted position. Therefore, the thread trimming holder 35 is allowed to move to the lower side in the raised position. Further, before mounting the small-diameter bobbin 18 on the spool shaft 32, the detection lever 41 is arranged at the pressing position by the operation of the user.

Then, the spool shaft 32 is inserted into the core portion 18A of the small-diameter bobbin 18, and the small-diameter bobbin 18 is placed on the upper side of the thread trimming holder 35. In this state, the engaging hook 33A of the bobbin stopper 33 is pressed by the core portion 18A and elastically deformed inward in the radial direction of the spool shaft 32. Therefore, the mounting of the small-diameter bobbin 18 is incomplete. Because of this, the small-diameter bobbin 18 is pushed downward against the urging force of the holder urging spring 37 to lower the thread trimming holder 35 to the lowered position. As a result, as shown in FIG. 6A, the engaging hook 33A of the bobbin stopper 33 protrudes upward from the core portion 18A and engages with the upper end portion of the core portion 18A. As a result, the thread trimming holder 35 and the engaging hook 33A of the bobbin stopper 33 vertically sandwiches the small-diameter bobbin 18, and the mounting of the small-diameter bobbin 18 is completed.

Figure 8A:
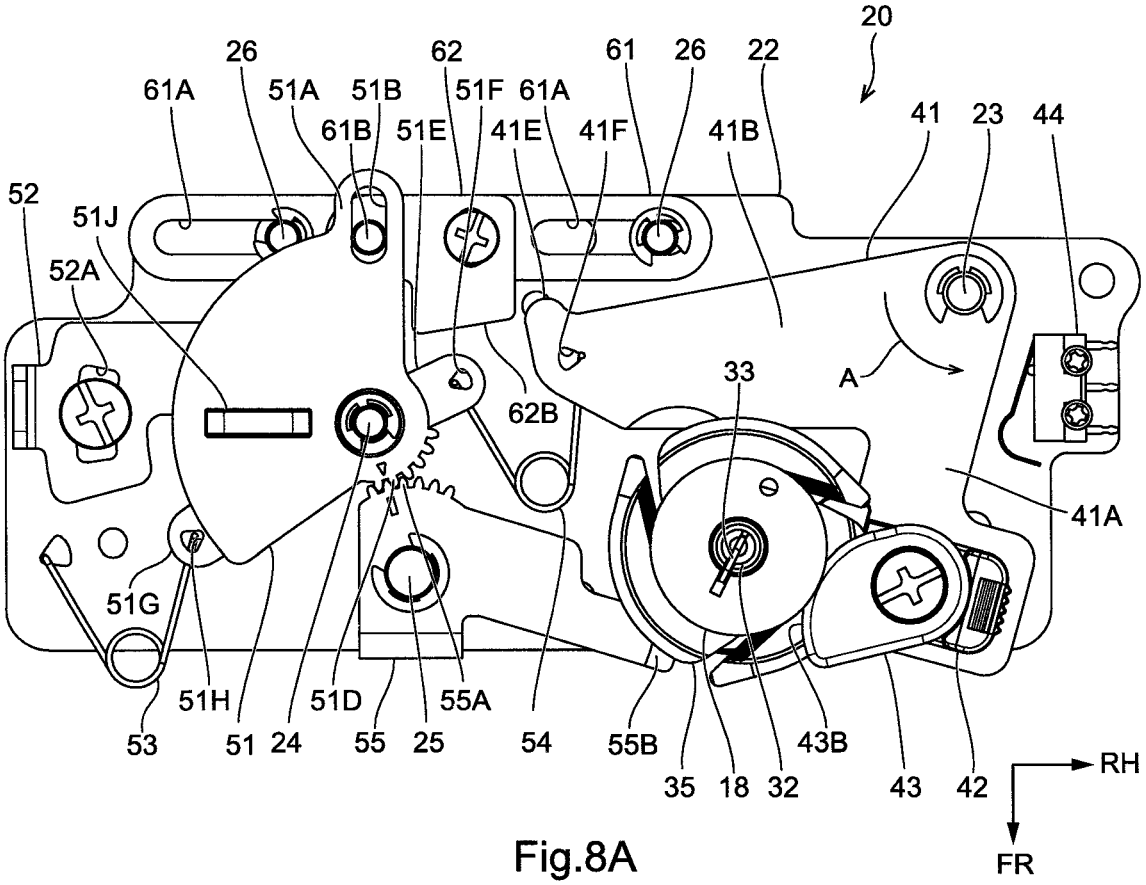
FIG. 8A is a plan view showing a state in which the detection lever shown in FIG. 3 is rotated from the pressed position to the non-pressed position.

After the mounting of the small-diameter bobbin 18 on the spool shaft 32 is completed, the detection lever 41 is rotated to the other side in the rotation direction by the operation of the user to be arranged at the non-pressing position. As a result, as shown in FIG. 8A, the contact portion 43B of the lever contact 43 is arranged inside the small-diameter bobbin 18, and is arranged so as to be spaced apart on the radial outside of the core portion 18A of the small-diameter bobbin 18. Further, the pressure on the detection switch 44 of the first lever arm 41A of the detection lever 41 is released.

In this state, when the user operates the operation button 16, the spool motor 31 is driven by the control unit 70, and the bobbin thread is started to be wound around the small-diameter bobbin 18. When the bobbin thread is wound around the core portion 18A of the small-diameter bobbin 18, the winding diameter of the bobbin thread wound around the core portion 18A increases as the spool shaft 32 rotates, and the wound bobbin thread comes into contact with the contact portion 43B of the lever contact 43. As a result, as the winding diameter of the bobbin thread increases, the bobbin thread presses the lever contact 43, and the detection lever 41 rotates from the non-pressing position to one side in the rotation direction (arrow A direction side in FIG. 8) against the urging force of the switching spring 54.

Figure 8B:
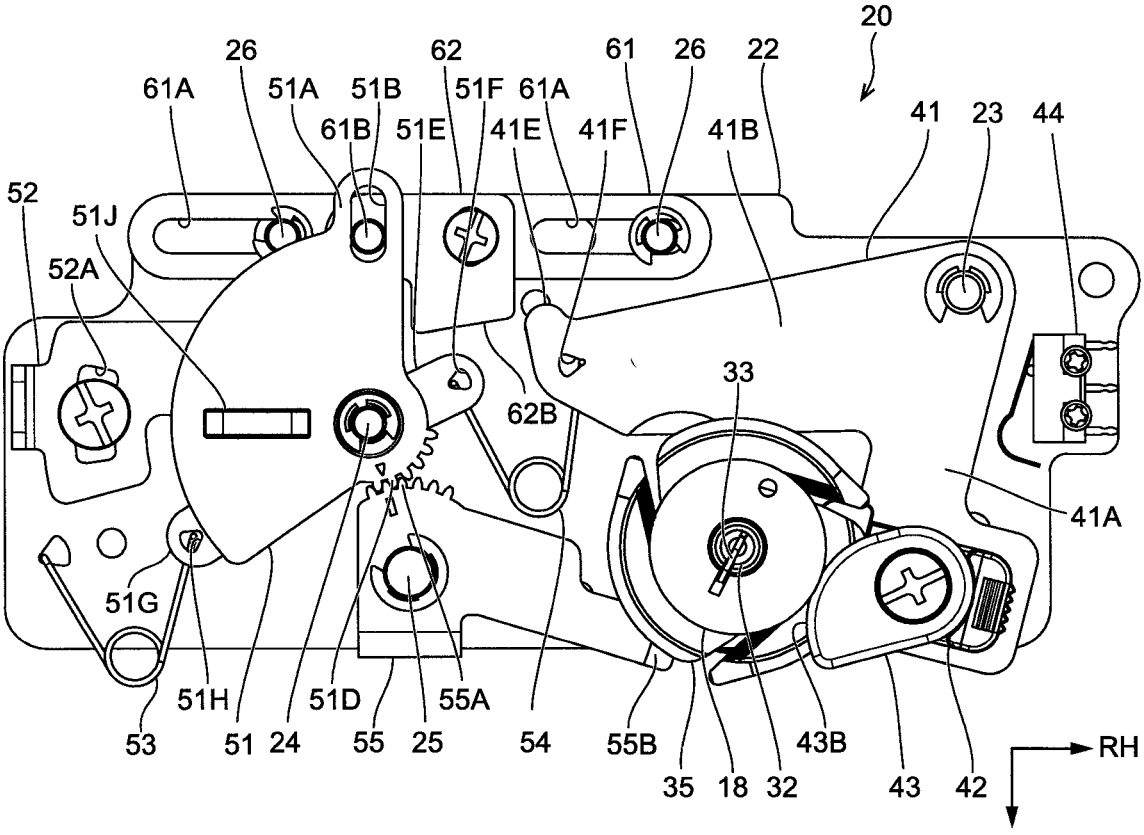
FIG. 8B is a plan view showing a state in which the detection lever is rotated to one side in the rotation direction from the state of FIG. 8A and is arranged at an intermediate position.

Then, as shown in FIG. 8B, when the winding diameter of the bobbin thread becomes slightly smaller than the outer diameter of the small-diameter bobbin 18, the detection lever reaches the intermediate position. At the intermediate position of the detection lever 41, the direction of the urging force of the switching spring 54 is reversed, and the switching spring 54 urges the detection lever 41 to one side in the rotation direction. As a result, the urging force of the switching spring 54 causes the detection lever 41 to rotate from the intermediate position to the pressing position to press the detection switch 44. As a result, the control unit 70 stops driving the spool motor 31, and winding of the bobbin thread around the small-diameter bobbin 18 is completed.

[Configuration of Large-Diameter Bobbin Mode of Bobbin Winding Device 20]

As shown in FIG. 9, in the large-diameter bobbin mode of the bobbin winding device 20, the user rotates the switching lever 51 to one side in the rotation direction to arrange the switching lever 51 at the switching position. Thus, the interlocking lever 55 is rotated to the blocking position in conjunction with the rotation of the switching lever 51. As a result, the blocking portion 55B of the interlocking lever 55 is arranged in the lower side of the holder stopper 36, and the thread trimming holder 35 is prevented from descending to the lowered position. Although not shown, the detection lever 41 is arranged at the pressing position by the user's operation before mounting the large-diameter bobbin 19 on the spool shaft 32, as in the small-diameter bobbin mode.

Figure 6B:
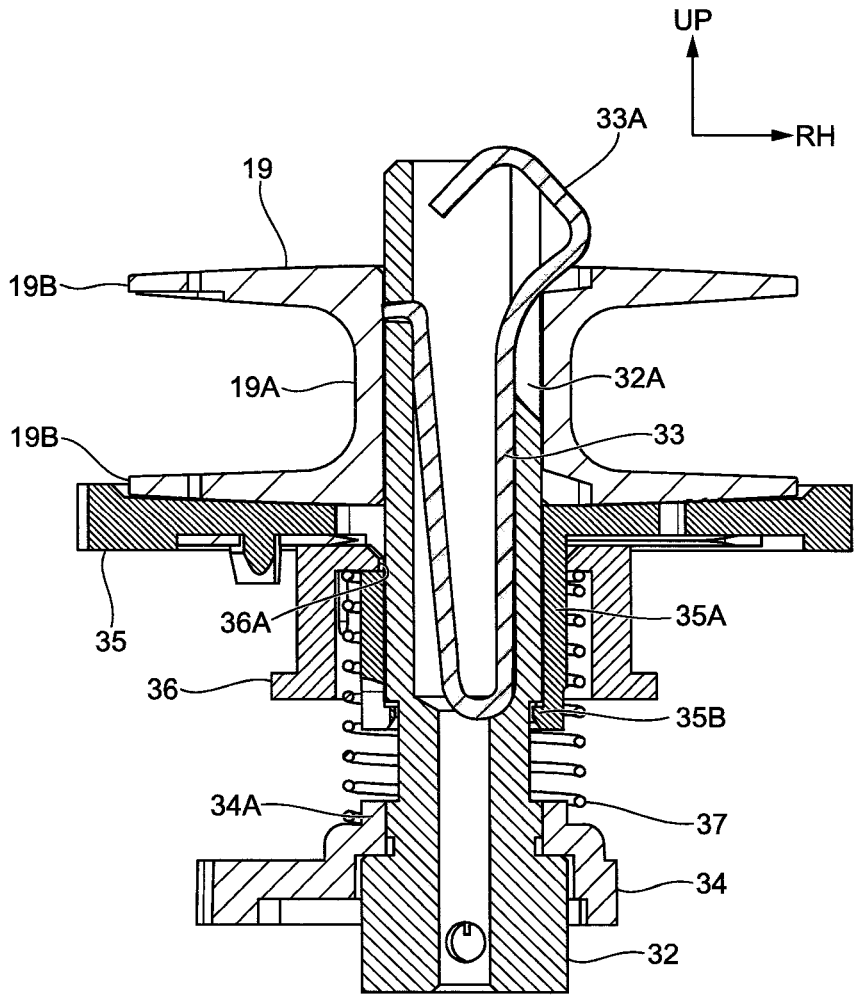
FIG. 6B is a vertical cross-sectional view showing a state in which a large-diameter bobbin is attached to the upper end of the spool shaft shown in FIG. 3.

Then, as shown in FIG. 6B, the spool shaft 32 is inserted into the core portion 19A of the large-diameter bobbin 19, and the large-diameter bobbin 19 is arranged on the upper side of the thread trimming holder 35. In this state, the engaging hook 33A of the bobbin stopper 33 protrudes upward from the core portion 19A and engages with the upper end portion of the core portion 19A. As a result, the thread trimming holder 35 and the engaging hook 33A of the bobbin stopper 33 vertically sandwiches the large-diameter bobbin 19, and the mounting of the large-diameter bobbin 19 is completed.

After the mounting of the large-diameter bobbin 19 on the spool shaft 32 is completed, the detection lever 41 is rotated to the other side in the rotation direction and placed in the non-pressing position by the operation of the user as in the small-diameter bobbin mode. As a result, the contact portion 43B of the lever contact 43 is arranged inside the large-diameter bobbin 19 and arranged so as to be spaced apart on the radial outside of the core portion 19A of the large-diameter bobbin 19. Further, at the non-pressing position of the detection lever 41, the pressing of the first lever arm 41A of the detection lever 41 against the detection switch 44 is released.

In this state, when the user operates the operation button 16, the spool motor 31 is driven by the control unit 70, and the bobbin thread is started to be wound around the large-diameter bobbin 19. When the bobbin thread is wound around the core portion 19A of the large-diameter bobbin 19, as similar to above, as the winding diameter of the bobbin thread increases, the bobbin thread presses the lever contact 43, and the detection lever 41 rotates from the non-pressing position to one side in the rotation direction against the urging force of the switching spring 54.

In the large-diameter bobbin mode, since the switching lever 51 is arranged at the switching position, the intermediate position of the detection lever 41 is changed to one side in the rotation direction as compared with the small-diameter bobbin mode. That is, the position of the lever contact 43 corresponding to the intermediate position of the detection lever 41 is changed to the radial outer side of the core portion 19A as compared with the small-diameter bobbin mode. When the winding diameter of the bobbin thread becomes slightly smaller than the outer diameter of the large-diameter bobbin 19, the detection lever 41 reaches the intermediate position. At the intermediate position of the detection lever 41, the direction of the urging force of the switching spring 54 is reversed, and the switching spring 54 urges the detection lever 41 to one side in the rotation direction. Thereby, the urging force of the switching spring 54 causes the detection lever 41 to rotate from the intermediate position to the pressing position to press the detection switch 44. As a result, the control unit 70 stops driving the spool motor 31, and winding the bobbin thread around the large-diameter bobbin 19 is completed.

As described above, in the large-diameter bobbin mode of the bobbin winding device 20, the switching lever 51 is arranged at the switching position. Further, the interlocking lever 55 is rotated to the blocking position in conjunction with the rotation of the switching lever 51, and the blocking portion 55B of the interlocking lever 55 is arranged at the lower side of the holder stopper 36, and the lowering of the thread trimming holder 35 at the raised position is blocked by the holder stopper 36. Therefore, if the small-diameter bobbin 18 is mounted on the spool shaft 32 in the large-diameter bobbin mode, the small-diameter bobbin 18 is arranged on the upper side of the regular mounting position (see FIG. 11) and mounting of the small-diameter bobbin 18 at the regular mounting position is prohibited. Thereby, the engaging hook 33A of the bobbin stopper 33 does not engage with the upper end portion of the core portion 18A of the small-diameter bobbin 18, and the engaging hook 33A and the thread trimming holder 35 do not sandwich the small-diameter bobbin 18 in the upper-lower direction. Therefore, when the spool shaft 32 is rotated by the spool motor 31 in this state, the small-diameter bobbin 18 idles with respect to the spool shaft 32, and the bobbin is not wound around the small bobbin 18. As a result, even if the small-diameter bobbin 18 is attached to the spool shaft 32 in the large-diameter bobbin mode, it is possible to prevent the bobbin thread from being wound around the small-diameter bobbin 18. As described above, according to the bobbin winding device 20, it is possible to suppress the bobbin winding failure with respect to the small-diameter bobbin 18 and the large-diameter bobbin 19.

In the small-diameter bobbin mode of the bobbin winding device 20, the thread trimming holder 35 is allowed to be lowered from the raised position to the lowered position. That is, in the small-diameter bobbin mode, the thread trimming holder 35 is maintained in the raised position even when the large-diameter bobbin 19 is attached to the spool shaft 32. In other words, the large-diameter bobbin 19 can be attached to the spool shaft 32 in the small-diameter bobbin mode. When the large-diameter bobbin 19 is attached to the spool shaft 32 and the bobbin thread is wound around the large-diameter bobbin 19 in the small-diameter bobbin mode, the winding diameter of the wound bobbin thread is smaller than that in the large-diameter bobbin mode. That is, the bobbin thread is wound around the large-diameter bobbin 19 with a smaller winding diameter than in the large-diameter bobbin mode. Therefore, even if the bobbin thread is wound around the large-diameter bobbin 19 in the small-diameter bobbin mode of the bobbin winding device 20, it is possible to prevent the bobbin thread from being excessively wound around the large-diameter bobbin 19.

Further, a slide member 61 that slides in conjunction with the rotation of the switching lever 51 is connected to the switching lever 51, and an adjusting plate 62 is fixed to the slide member 61. The non-pressing position of the detection lever 41 is changed to one side in the rotation direction by rotating the switching lever 51 from the initial position to the switching position and the lever protrusion 41E of the detection lever 41 in the non-pressing position abuts on the adjusting portion 62B of the adjusting plate 62. That is, in the large-diameter bobbin mode of the bobbin winding device 20, the non-pressing position of the detection lever 41 is changed to one side in the rotation direction of the detection lever 41 as compared with the small-diameter bobbin mode of the bobbin winding device 20. As a result, the bobbin thread can be satisfactorily wound around the large-diameter bobbin 19.

That is, when winding the bobbin thread around the large-diameter bobbin 19, the bobbin thread wound around the core 19A presses the lever contact 43 to rotate the detection lever 41 to one side in the rotation direction against the urging force of the switching spring 54. At this time, a contact resistance is generated between the bobbin thread and the lever contact 43. Further, the winding diameter of the bobbin thread wound on the large-diameter bobbin 19 is set to be larger than the winding diameter of the bobbin thread wound on the small-diameter bobbin 18. In other words, the position of the lever contact 43 corresponding to the intermediate position of the detection lever 41 in the large-diameter bobbin mode is set to be radially outside the spool shaft 32 as compared with the position of the lever contact 43 corresponding to the intermediate position of the detection lever 41 in the small-diameter bobbin mode.

If the position adjusting mechanism unit 60 is omitted in the bobbin winding device 20, the non-pressing position of the detection lever 41 in the large-diameter bobbin mode is the same as the non-pressing position of the detection lever 41 in the small-diameter bobbin mode. That is, the position of the lever contact 43 in the large-diameter bobbin mode becomes a position close to the large-diameter bobbin 19 (see lever contact 43 indicated by two-dot chain line in FIG. 9). Therefore, the contact period (the period from the start of contact of the bobbin thread with the lever contact 43 until the lever contact 43 reaches the position corresponding to the intermediate position of the detection lever 41 and the contact state between the bobbin thread and the lever contact 43 is released) between the bobbin thread and the lever contact 43 is longer than that in the present embodiment. The torque of the spool motor 31 is set to be relatively low. Therefore, if the position adjusting mechanism unit 60 is omitted in the bobbin winding device 20, the contact resistance between the bobbin thread and the lever contact 43 may hinder the rotation of the spool motor 31 and prevent the bobbin thread from being wound well on the large-diameter bobbin 19.

Whereas, in the bobbin winding device 20 of the first embodiment, in the large-diameter bobbin mode, the non-pressing position of the detection lever 41 is changed to one side in the rotation direction by contacting the lever protrusion 41E of the detection lever 41 in the non-pressing position with the adjusting portion 62B of the adjusting plate 62. As a result, the contact period between the bobbin thread and the lever contact 43 can be shortened as compared with the case where the position adjusting mechanism unit 60 is omitted. Therefore, it is possible to suppress the rotation failure of the spool motor 31 due to the contact resistance between the bobbin thread and the lever contact 43, and it is possible to satisfactorily wind the bobbin thread around the large-diameter bobbin 19.

Further, in the position adjusting mechanism unit 60, the left end portion of the adjusting plate 62 is rotatably supported by the connecting pin 61B. Further, a fixing hole 62A through which the screw SC4 is inserted is formed through the right end portion of the lever stopper 52, and the fixing hole 62A is formed in an oblong hole shape with the rotation direction of the adjusting plate 62 as the longitudinal direction. As a result, the position of the adjustment plate can be appropriately changed to finely adjust the non-pressing position of the detection lever 41 in the large-diameter bobbin mode.

Further, in the switching mechanism unit 50, the fixing hole 52A of the lever stopper 52 is formed in an oblong hole shape in which the rotation direction of the lever stopper 52 is the longitudinal direction. Therefore, the fixed position of the lever stopper 52 can be changed to finely adjust the switching position of the switching lever 51. That is, the intermediate position of the detection lever 41 in the large-diameter bobbin mode can be finely adjusted to set the winding diameter of the bobbin thread with respect to the large-diameter bobbin 19 to an appropriate winding diameter.

Further, in the switching mechanism unit 50, the switching gear portion 51D of the switching lever 51 and the interlocking gear portion 55A of the interlocking lever 55 are engaged with each other, and the interlocking lever 55 rotates in conjunction with the rotation of the switching lever 51. In the large-diameter bobbin mode, the blocking portion 55B of the interlocking lever 55 is arranged in the lower part of the holder stopper 36 so that it can come into contact with the holder stopper 36. That is, in the large-diameter bobbin mode, the blocking portion 55B of the interlocking lever 55 indirectly abuts on the thread trimming holder 35 to prevent the thread trimming holder 35 from descending to the lowered position. As a result, it is possible to prevent the small-diameter bobbin 18 from being mounted at the regular position in the large-diameter bobbin mode with a simple configuration.

Further, in the large-diameter bobbin mode, when the holder stopper 36 comes into contact with the blocking portion 55B, the rotation of the holder stopper 36 is restricted. The holder stopper 36 is configured to be integrally rotatable with the thread trimming holder 35, and the thread trimming holder 35 is configured to be integrally rotatable with the spool shaft 32. Thereby, when the holder stopper 36 comes into contact with the blocking portion 55B, the rotation of the spool shaft 32 can be blocked. Therefore, in the large-diameter bobbin mode, it is possible to prevent the bobbin thread from being wound around the erroneously mounted small-diameter bobbin 18.

In the first embodiment, in the large-diameter bobbin mode, the blocking portion 55B of the interlocking lever 55 is configured to be able to indirectly contact the thread trimming holder 35, but the blocking portion 55B of the interlocking lever 55 may be configured to be able to directly contact the thread trimming holder 35.

Further, in the first embodiment, the raised position of the thread trimming holder 35 may be changed slightly above the position shown in FIG. 6B. As a result, when the large-diameter bobbin 19 is attached to the spool shaft 32, the large-diameter bobbin 19 is pushed downward against the urging force of the holder urging spring 37 to lower the thread trimming holder 35 to the raised position before the change. Therefore, for example, the axial dimensional variation of the large-diameter bobbin 19 due to the dimensional tolerance or the like can be absorbed by the holder urging spring 37, and the large-diameter bobbin 19 can be mounted on the spool shaft 32.

[Variation of the Switching Mechanism Unit 50]

Figure 12:
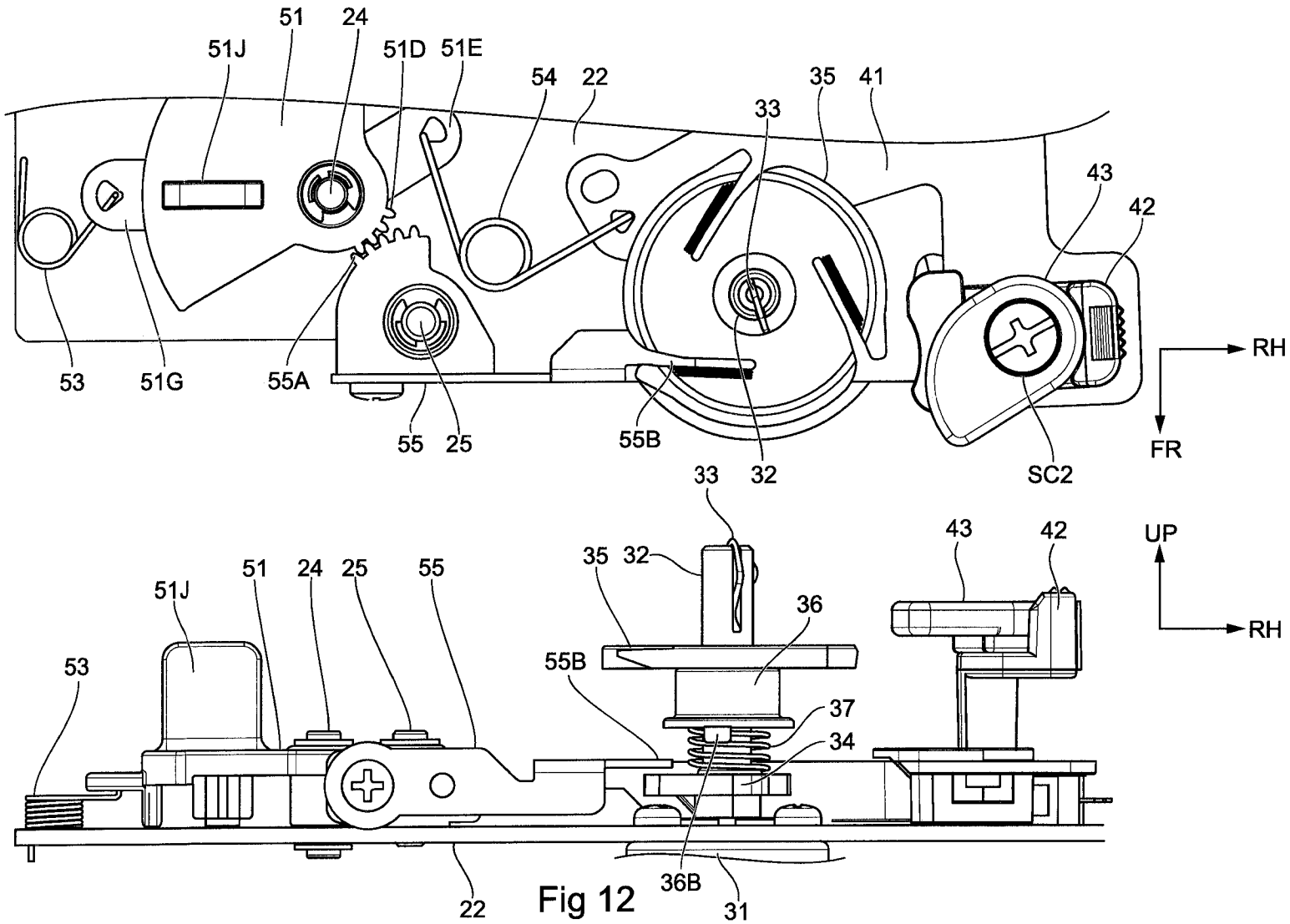
FIG. 12 is an explanatory drawing corresponding to FIG. 10 for explaining a state in a small-diameter bobbin mode in a variation of the switching mechanism unit.
Figure 13:
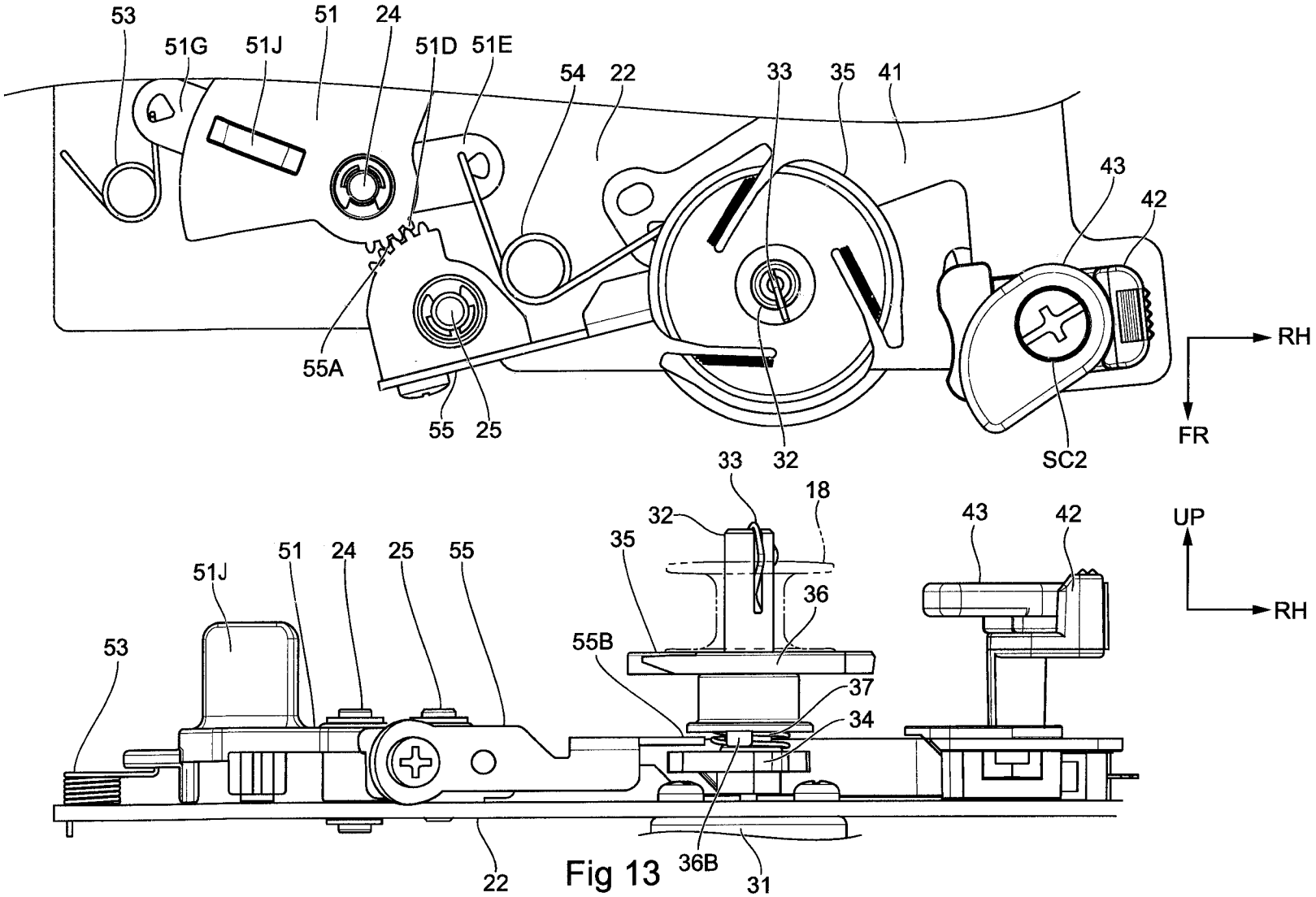
FIG. 13 is an explanatory drawing for explaining a state in which a small-diameter bobbin is mounted on a spool shaft in a large-diameter bobbin mode of a variation of the switching mechanism unit.
Figure 14:
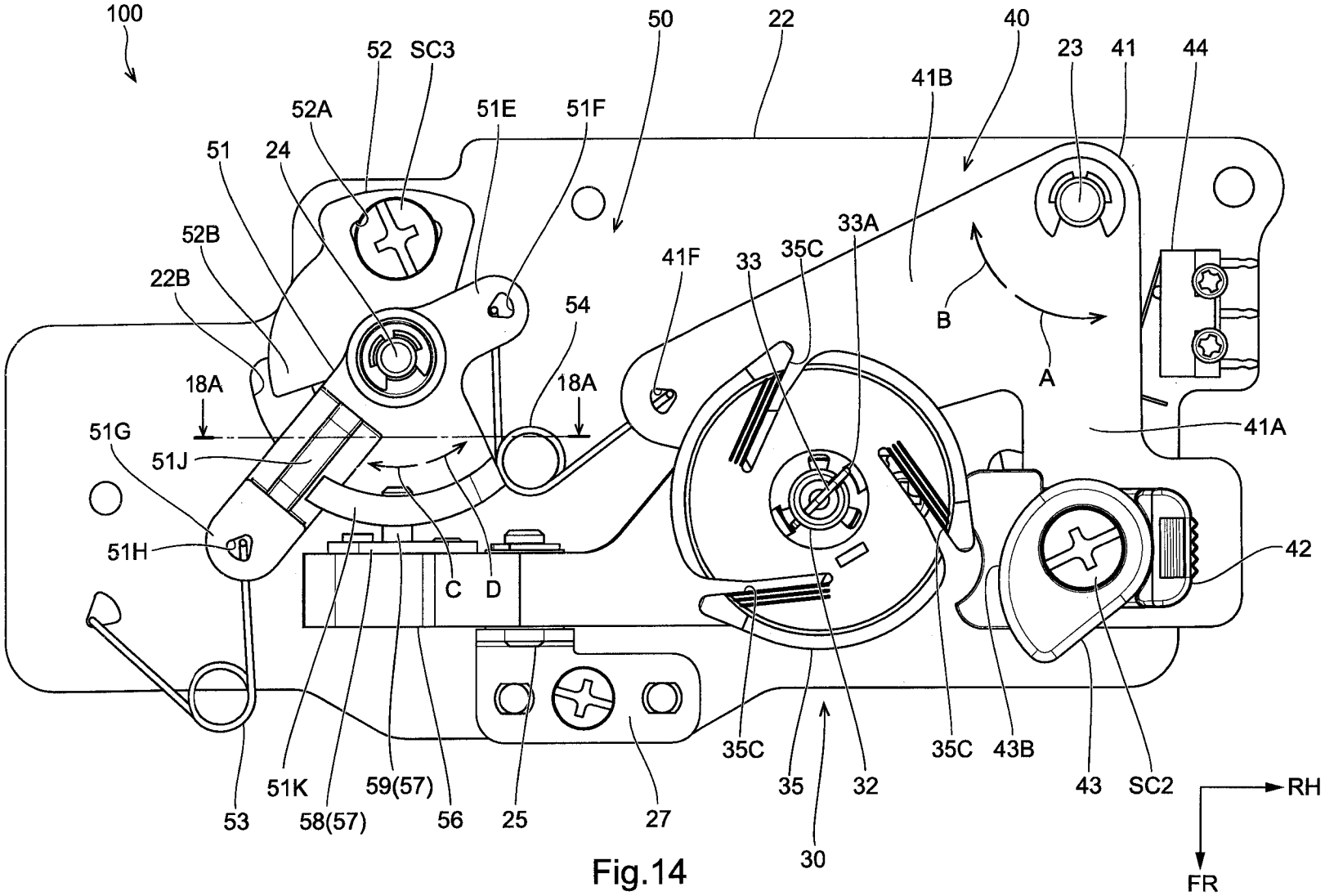
FIG. 14 is a plan view which shows the bobbin winding device according to second embodiment.
Figure 15:
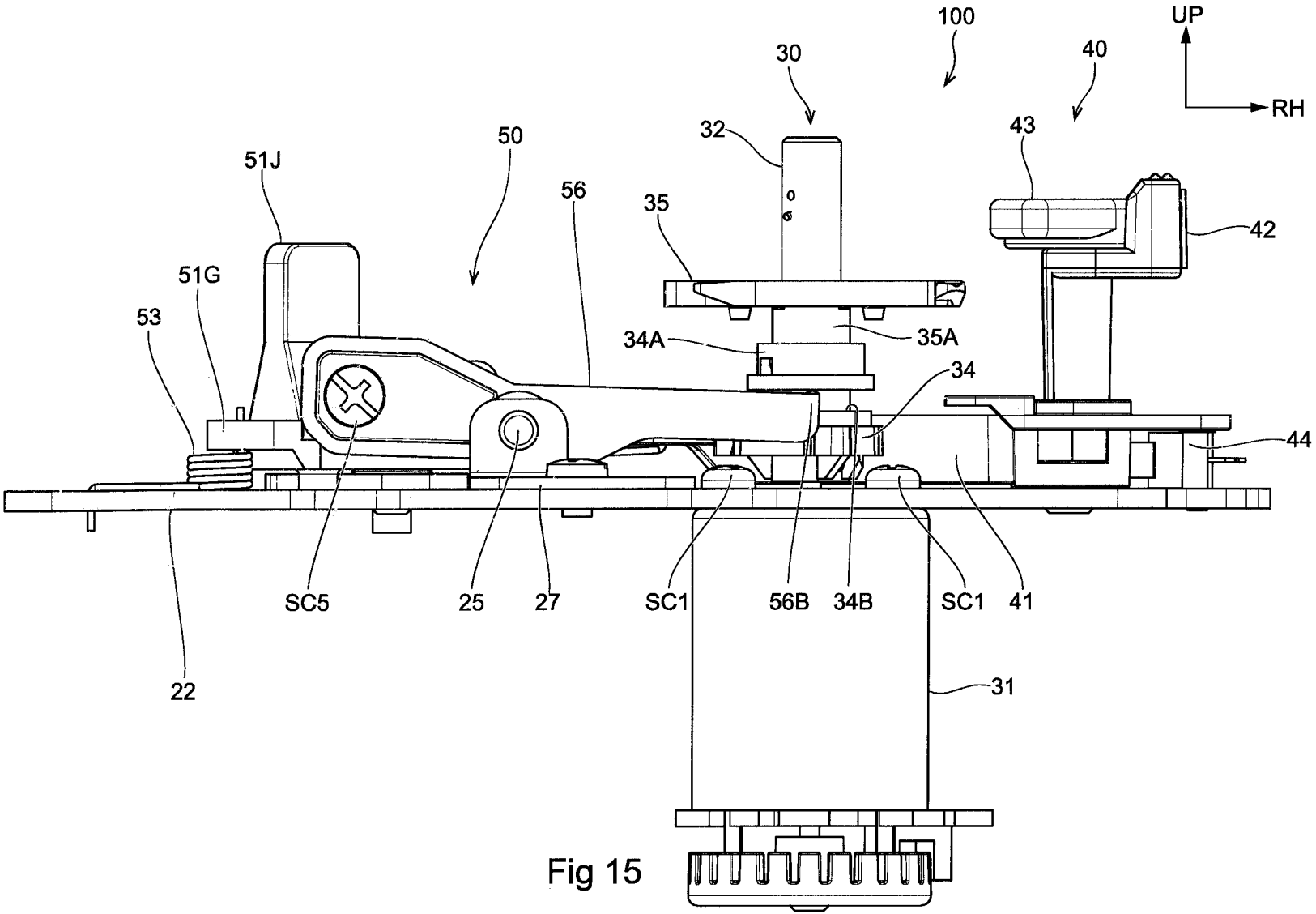
FIG. 15 is a front view seen from the front side of the bobbin winding device shown in FIG. 14.

Next, a variation of the switching mechanism unit 50 in the first embodiment will be described with reference to FIGS. 12 and 13. As shown in these figures, in the variation of the switching mechanism unit 50, in the large-diameter bobbin mode of the bobbin winding device 20, the blocking portion 55B of the interlocking lever 55 is arranged apart from the lower side of the holder stopper 36. More specifically, even when the thread trimming holder 35 is arranged in the lowered position, a gap is formed between the blocking portion 55B of the interlocking lever 55 and the lower surface of the holder stopper 36 in the blocking position in the upper-lower direction (see FIG. 13). That is, in the variation of the switching mechanism unit 50, even in the large-diameter bobbin mode of the bobbin winding device 20, the thread trimming holder 35 is configured to be allowed to descend from the raised position to the lowered position.

Further, in the bobbin winding device 20 to which the variation of the switching mechanism unit 50 is applied, a protrusion 36B (in a broad sense, it is an element that is grasped as a "contacted portion") is formed on the lower surface of the holder stopper 36, and the protrusion 36B is formed in a roughly columnar shape with the upper-lower direction as the axial direction. Then, in the state where the thread trimming holder 35 is arranged in the lowered position in the large-diameter bobbin mode, the protrusion 36B is arranged at a position overlapping the blocking portion 55B in the upper-lower direction and the radial direction of the spool shaft 32. Thereby, in the large-diameter bobbin mode of the bobbin winding device 20 and in the lowered position of the thread trimming holder 35, when the holder stopper 36 rotates together with the spool shaft 32, the protrusion 36B comes into contact with the blocking portion 55B, and the rotation of the spool shaft 32 and the holder stopper 36 is blocked.

When the small-diameter bobbin 18 is mounted on the spool shaft 32 in the small-diameter bobbin mode of the bobbin winding device 20, the thread trimming holder 35 and the holder stopper 36 are arranged at the lowered positions as in the first embodiment, but the interlocking lever 55 is arranged at the permitted position. Specifically, the blocking portion 55B of the interlocking lever 55 is arranged radially outside the spool shaft 32 with respect to the protrusion 36B of the holder stopper 36. Therefore, even if the spool shaft 32 rotates, the protrusion 36B does not come into contact with the blocking portion 55B of the interlocking lever 55. As a result, the bobbin winding device 20 can properly wind the bobbin thread around the small-diameter bobbin 18.

Further, when the large-diameter bobbin 19 is mounted on the spool shaft 32 in the large-diameter bobbin mode of the bobbin winding device 20, the arrangement state of the thread trimming holder 35 and the holder stopper 36 at the raised positions is maintained as in the first embodiment. Further, in the large-diameter bobbin mode, the interlocking lever 55 is arranged at the blocking position, but the protrusion 36B of the holder stopper 36 is arranged above the blocking portion 55B of the interlocking lever 55 in the side view. Therefore, even if the spool shaft 32 rotates, the protrusion 36B does not come into contact with the blocking portion 55B of the interlocking lever 55. Further, in the large-diameter bobbin mode, the switching lever 51 is arranged at the switching position. Therefore, the bobbin winding device 20 can properly wind the bobbin thread around the large-diameter bobbin 19.

On the other hand, when the small-diameter bobbin 18 is temporarily attached to the spool shaft 32 in the large-diameter bobbin mode of the bobbin winding device 20, the thread trimming holder 35 is pressed downward by the small-diameter bobbin 18 and descends to the lowered position.

Therefore, even in the large-diameter bobbin mode, the small-diameter bobbin 18 is mounted at the regular mounting position. However, in this state, as described above, the blocking portion 55B of the interlocking lever 55 arranged at the blocking position is arranged at a position overlapping the protrusion 36B in the upper-lower direction and the radial direction of the spool shaft 32. Therefore, when the spool shaft 32 rotates, the protrusion 36B comes into contact with the blocking portion 55B, and the blocking portion 55B prevents the spool shaft 32 from rotating. As a result, even if the small-diameter bobbin 18 is attached to the spool shaft 32 in the large-diameter bobbin mode, it is possible to prevent the bobbin thread from being wound around the small-diameter bobbin 18. As described above, even in the variation of the switching mechanism unit 50, it is possible to suppress the winding defect of the bobbin thread with respect to the small-diameter bobbin 18 and the large-diameter bobbin 19 as in the first embodiment.

In the variety of the switching mechanism unit 50, in the large-diameter bobbin mode, the blocking portion 55B of the interlocking lever 55 indirectly contacts the thread trimming holder 35 to prevent the rotation of the spool shaft 32. However, the blocking portion 55B of the interlocking lever may be directly brought into contact with the thread trimming holder 35 to prevent the rotation of the spool shaft 32.

Second Embodiment

Next, the bobbin winding device 100 of the second embodiment will be described with reference to FIGS. 14 to 21. The bobbin winding device 100 has the same configuration as the bobbin winding device 20 of the first embodiment except for the following points. In FIGS. 14 to 21, the members having the same structure as the bobbin winding device 20 are designated by the same reference numerals.

Figure 16A:
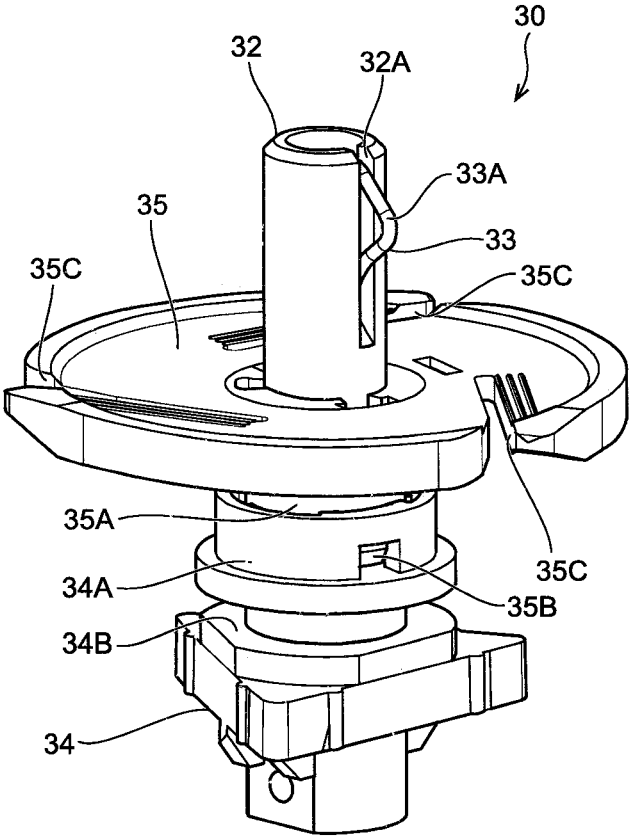
FIG. 16A is a perspective view showing the upper part of the bobbin winding mechanism unit shown in FIG. 14.
Figure 16B:
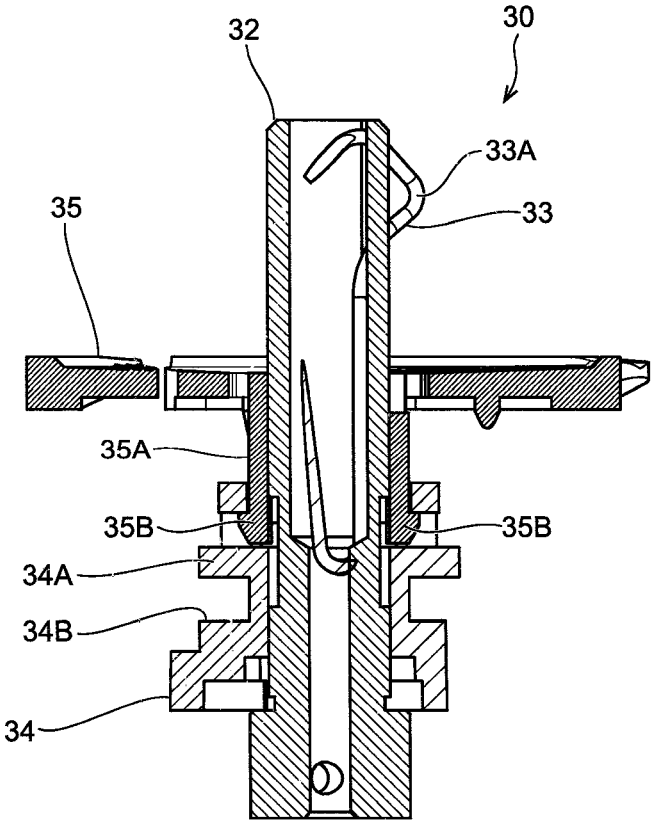
FIG. 16B is a vertical cross-sectional view of the bobbin winding mechanism unit shown in FIG. 16A.
Figure 17:
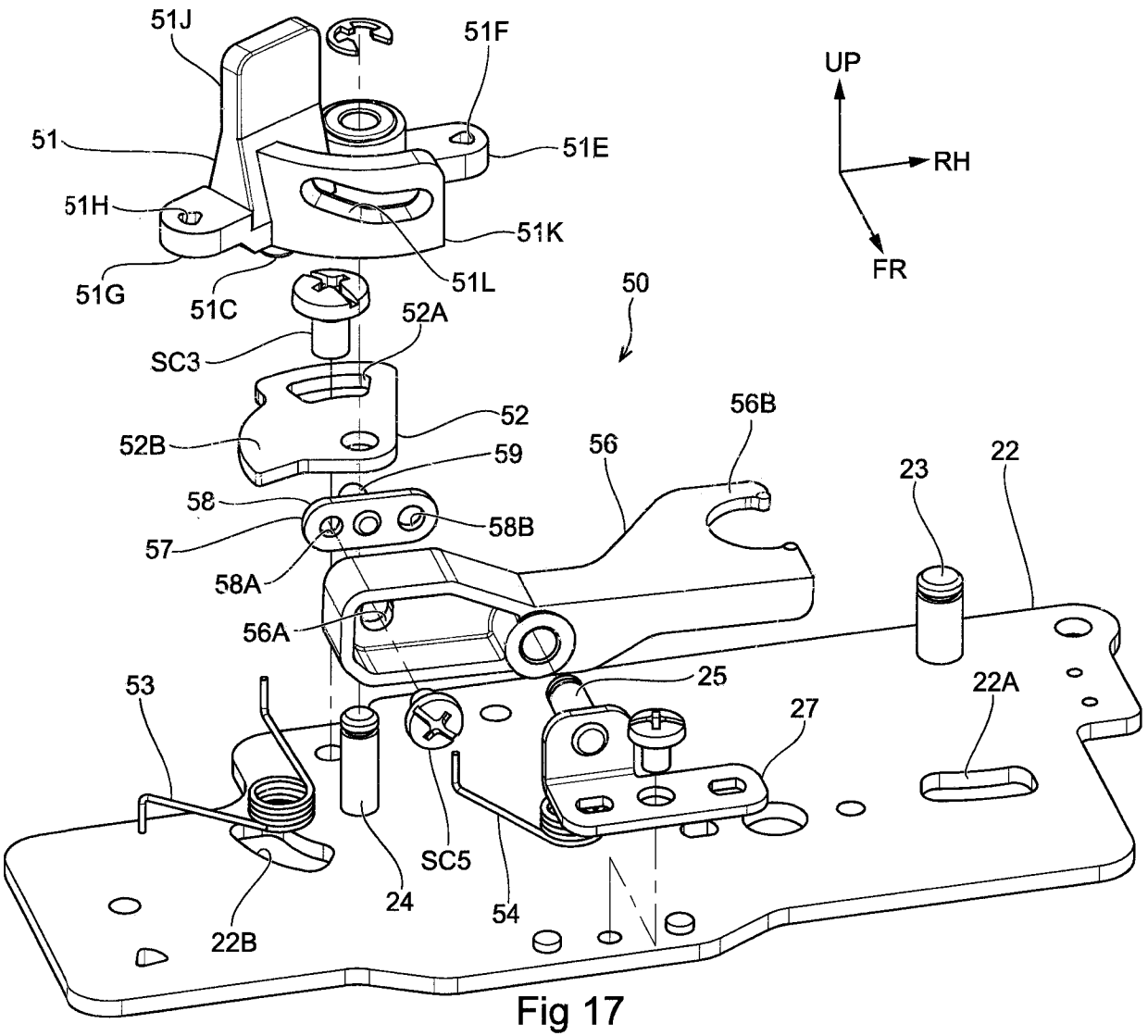
FIG. 17 is an exploded perspective view of the switching mechanism unit shown in FIG. 14.
Figure 18A:
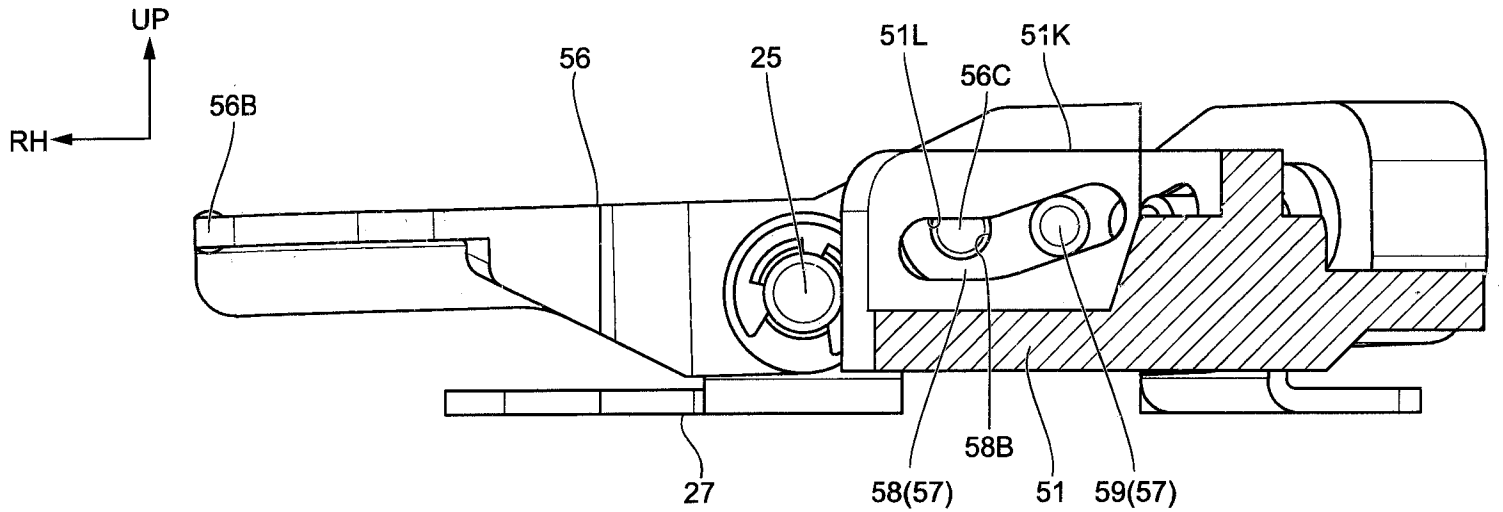
FIG. 18A is a cross-sectional view seen from the rear side showing a state in which the cam pin of the switching cam shown in FIG. 14 is inserted into the cam groove of the switching lever (cross-sectional view taken along the line 18A-18A in FIG. 14)
Figure 18B:
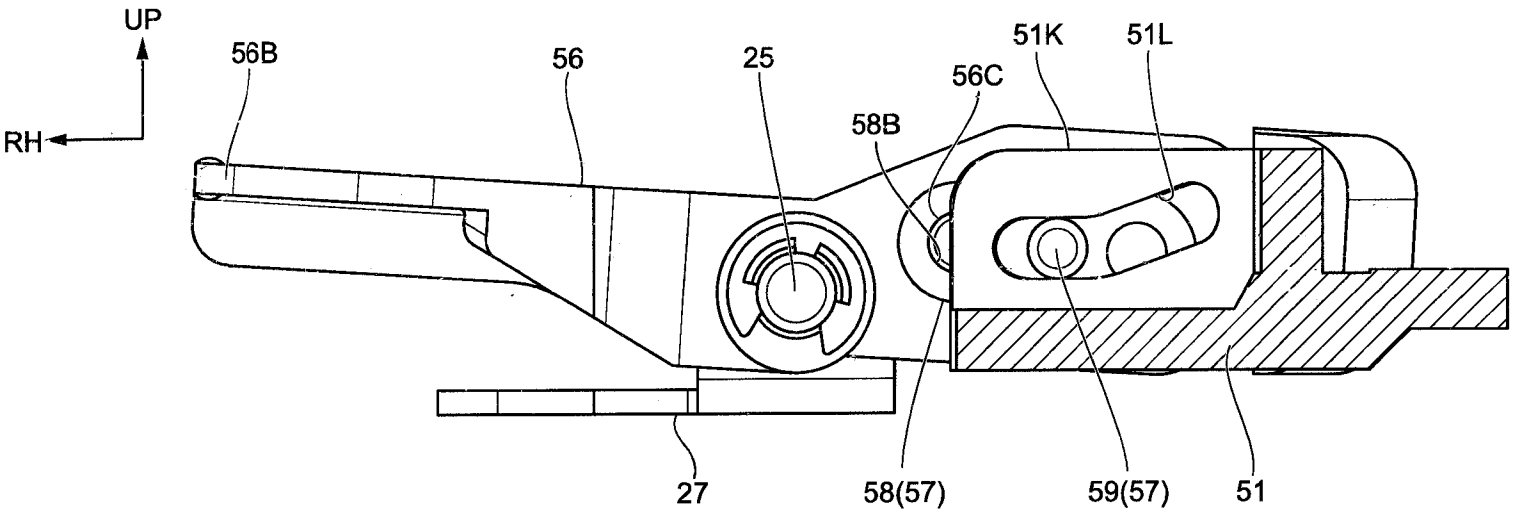
FIG. 18B is a cross-sectional view seen from the rear side showing the state of the switching cam when the switching lever is rotated to the switching position from the state shown in FIG. 18A.

As shown in FIG. 16, in the bobbin winding device 100 of the second embodiment, the holder stopper 36 and the holder urging spring 37 are omitted in the bobbin winding mechanism unit 30. Further, in the bobbin winding mechanism unit 30, the triangular cam 34 is configured to be relatively movable in the axial direction of the spool shaft 32. The thread trimming holder 35 is connected to the upper end of the mounting cylinder 34A of the triangular cam 34 by the hook portion 35B of the mounting portion 35A of the thread trimming holder 35 so as to be integrally rotatable and integrally movable in the axial direction of the spool shaft 32. The thread trimming holder 35 is configured to be arranged in a lowered position (positions shown in FIGS. 20A and 20B) or a raised position (positions shown in FIGS. 21A and 21B) by a switching cam 56 of the switching mechanism unit 50 described later. Then, as in the first embodiment, the small-diameter bobbin 18 is mounted on the spool shaft 32 in the lowered position (see FIG. 20A), and the large-diameter bobbin 19 is mounted on the spool shaft 32 in the raised position (see FIG. 21A). That is, in the second embodiment, the position of the thread trimming holder 35 is switched by the switching mechanism unit 50.

Further, a connecting groove 34B that engages with the switching cam 56, which will be described later, is formed on the outer peripheral portion of the intermediate portion in the upper-lower direction of the mounting cylinder portion 34A. The connecting groove 34B is opened to the outside in the radial direction of the mounting cylinder portion 34A, and is formed over the entire circumference of the mounting cylinder portion 34A in the circumferential direction.

As shown in FIGS. 14, and 17 to 19, the switching lever 51 of the switching mechanism unit 50 in the second embodiment is formed in a fan shape that is convex forward in a plan view. In the switching lever 51, the protruding portion 51A, the connecting hole 51B, and the switching gear portion 51D are omitted, and the connecting wall portion 51K is formed at the tip portion of the switching lever 51. The connecting wall portion 51K protrudes upward from the tip end portion of the switching lever 51 and is curved in an arc shape along the rotation direction of the switching lever 51 in a plan view. A cam groove 51L is formed through the connecting wall portion 51K. The cam groove 51L is inclined upward as viewed from the radial outside of the switching lever 51 toward one side in the rotation direction of the switching lever 51 (Arrow C direction side in FIG. 14). That is, one end of the cam groove 51L is arranged above the other end.

The lever stopper 52 is formed in a roughly fan-shaped plate shape centered on the second shaft 24, is rotatably supported by the second shaft 24, and extends rearward from the second shaft 24. A stopper portion 52B protruding to the left is formed on the outer peripheral portion of the lever stopper 52, and the stopper portion 52B closes the other end of the regulation hole 22B of the base plate 22 (see FIG. 14). Then, as in the first embodiment, at the initial position of the switching lever 51, the regulation pin 51C of the switching lever 51 (see FIG. 14) comes into contact with one end of the regulation hole 22B, and at the switching position of the switching lever 51, the regulation pin 51C of the switching lever 51 comes into contact with the stopper portion 52B of the lever stopper 52.

Further, as shown in FIGS. 14, 15, and 17 to 21, the switching mechanism unit 50 has a switching cam 56 as an "adjusting member" instead of the interlocking lever 55. The switching cam 56 is formed in a roughly long block shape with the front-rear direction as the thickness direction and the left-right direction as the longitudinal direction. The switching cam 56 is arranged on the front side of the switching lever 51, and the intermediate portion in the longitudinal direction of the switching cam 56 is rotatably supported by a third shaft 25 whose axial direction is the front-rear direction. The third shaft 25 is provided on the shaft holder 27, and the shaft holder 27 is fastened and fixed to the base plate 22.

The switching cam 56 has a cam connecting member 57, and is connected to the switching lever 51 by the cam connecting member 57. The cam connecting member 57 is configured to include a connecting plate 58 and a cam pin 59. The connecting plate 58 is formed in a roughly rectangular plate shape with the front-rear direction as the plate thickness direction and the left-right direction as the longitudinal direction. A screw portion 58A is formed at the left end portion of the connecting plate 58, and a circular insertion hole 58B is formed through the right end portion of the connecting plate 58. Then, the connecting plate 58 is arranged adjacent to the rear side of the left end portion of the switching cam 56, and the support pin 56C (see FIG. 18) formed in the switching cam 56 is inserted into the insertion hole 58B. This support pin 56C projects rearward from the switching cam 56 with the front-rear direction as the axial direction. As a result, the right end portion of the connecting plate 58 is rotatably supported by the switching cam 56 with the front-rear direction as the axial direction. Further, a fixing hole 56A (see FIG. 17) is formed through the left end portion of the switching cam 56, and the fixing hole 56A is formed in an oblong hole shape with the rotation direction of the switching cam 56 as the longitudinal direction. Then, the screw SC5 is inserted into the fixing hole 56A, screwed into the screw portion 58A of the connecting plate 58, and the connecting plate 58 is connected to the switching cam 56.

The cam pin 59 is formed in a roughly columnar shape with the front-rear direction as the axial direction, and extends from the middle portion in the left-right direction of the connecting plate 58 to the rear side. The rear end of the cam pin 59 is inserted into the cam groove 51L of the switching lever 51 so as to be relatively movable. As a result, the switching cam 56 is configured to rotate around the axis of the third shaft 25 in conjunction with the rotation of the switching lever 51. Specifically, at the initial position of the switching lever 51, the cam pin 59 is arranged at one end side of the cam groove 51L (see FIG. 18A), and at the switching position of the switching lever 51, the cam pin 59 is arranged at the other end side of the cam groove 51L (see FIG. 18B).

Further, a cam connecting portion 56B as a "connecting portion" is formed at the right end portion of the switching cam 56, and the cam connecting portion 56B is formed in a roughly C shape open to the right side. Then, the edge portion of the cam connecting portion 56B is inserted into the connecting groove 34B of the triangular cam 34 so that the edge portion of the cam connecting portion 56B and the connecting groove 34B of the triangular cam 34 can be engaged in the upper-lower direction. Further, the edge portion of the cam connecting portion 56B is inserted into the connecting groove 34B so as to allow the triangular cam 34 to rotate. As a result, it is configured that the triangular cam 34 (i.e. thread trimming holder 35) is displaced in the upper-lower direction by rotating the switching cam 56. Specifically, at the initial position of the switching lever 51, the thread trimming holder 35 is arranged at the lowered position, and at the switching position of the switching lever 51, the thread trimming holder 35 is arranged at the raised position.

Further, in the bobbin winding device 100 of the second embodiment, the position adjusting mechanism unit 60 is omitted.

Figure 19A:
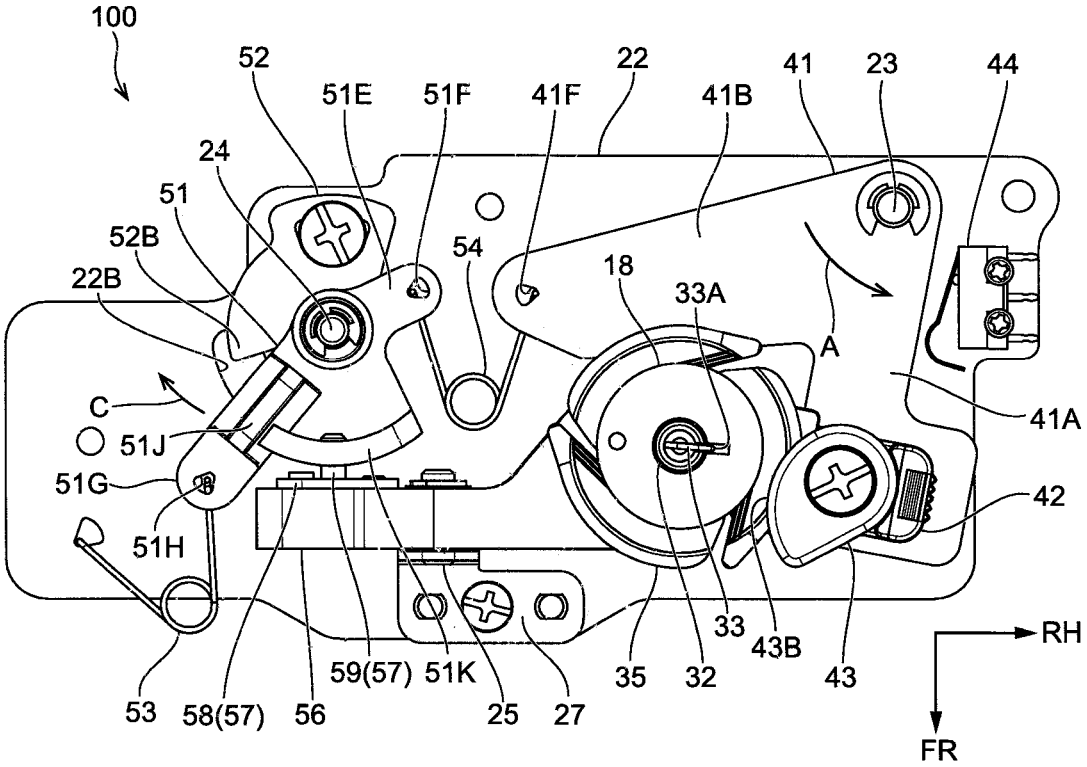
FIG. 19A is a plan view showing a state in which the small-diameter bobbin is mounted on the spool shaft and the detection lever is arranged in the non-pressing position in the small-diameter bobbin mode.
Figure 20A:
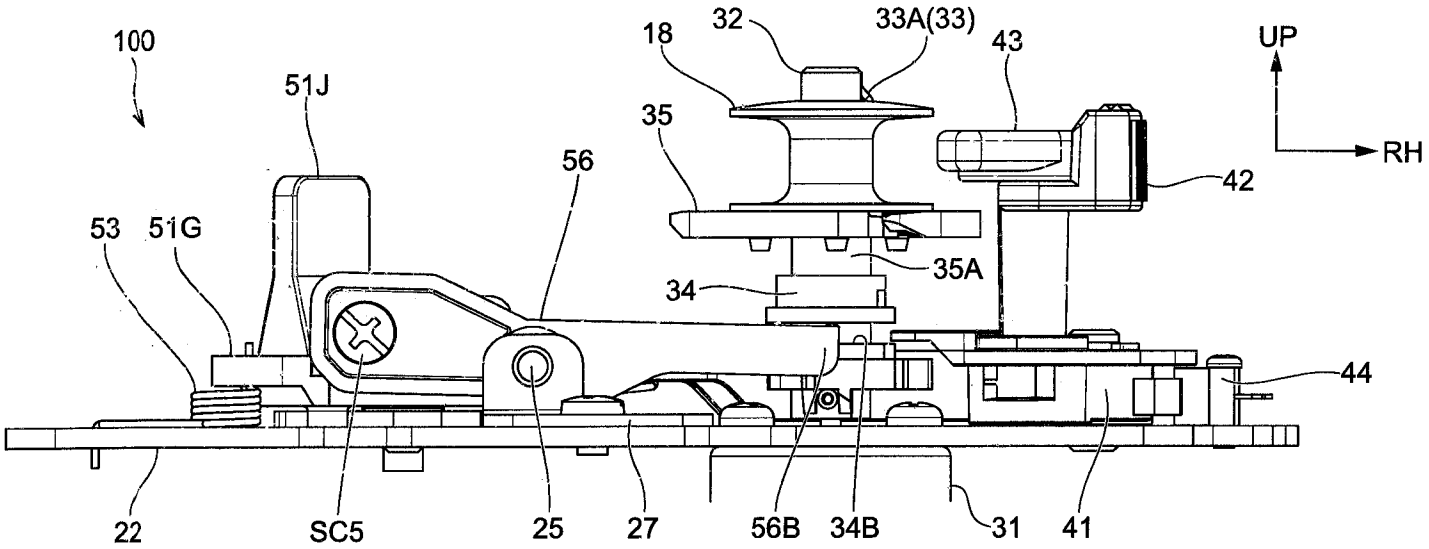
FIG. 20A is a front view of the state shown in FIG. 19A.
Figure 20B:
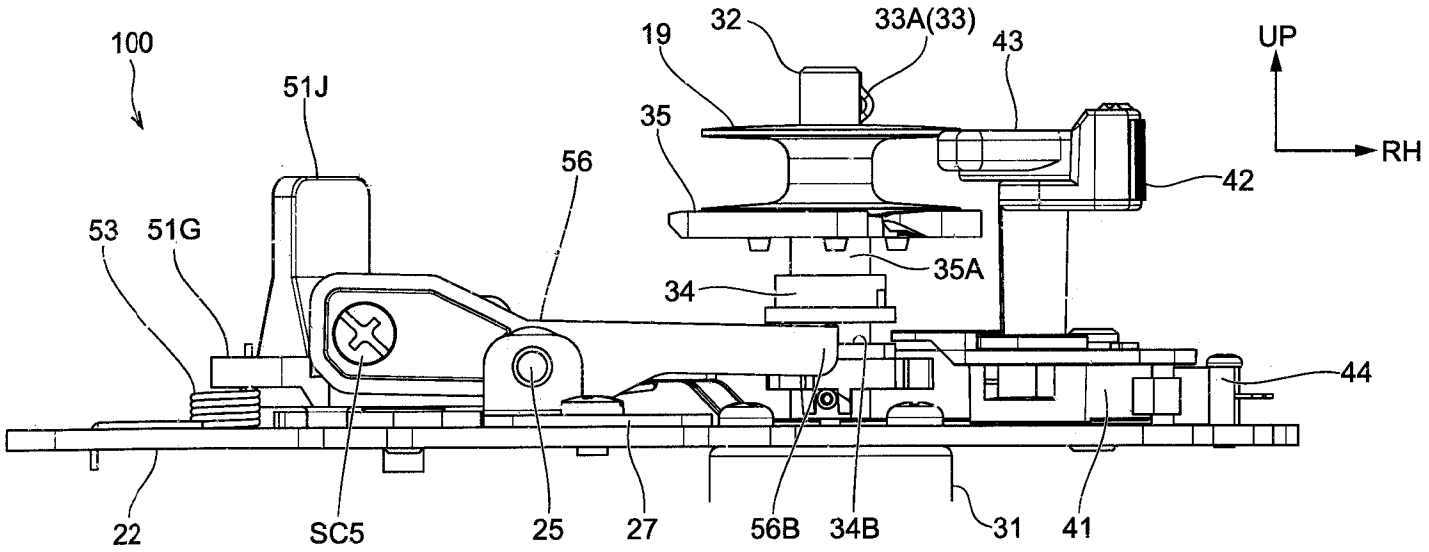
FIG. 20B is a front view which shows the state which the large-diameter bobbin is attached to the spool shaft in the small-diameter bobbin mode.

In the second embodiment, as shown in the FIGS. 19A and 20A, in the small-diameter bobbin mode of the bobbin winding device 100, the thread trimming holder 35 is arranged at the lowered position by the switching cam 56. As a result, the bobbin thread can be wound around the small-diameter bobbin 18 by attaching the small-diameter bobbin 18 to the bobbin shaft 32 and operating the bobbin winding device 100. Further, as shown in FIG. 20B, in the small-diameter bobbin mode of the bobbin winding device 100, since the thread trimming holder 35 is arranged in the lowered position, when the large-diameter bobbin 19 is mounted on the spool shaft 32, the large-diameter bobbin 19 is arranged below the regular mounting position. Therefore, if the large-diameter bobbin 19 is mounted in the small-diameter bobbin mode of the bobbin winding device 100, the core portion 19A of the large-diameter bobbin 19 and the engaging hook 33A of the bobbin stopper 33 do not engage with each other. As a result, even if the spool motor 31 is driven, the large-diameter bobbin 19 idles and the bobbin thread is not wound around the large-diameter bobbin 19.

Figure 19B:
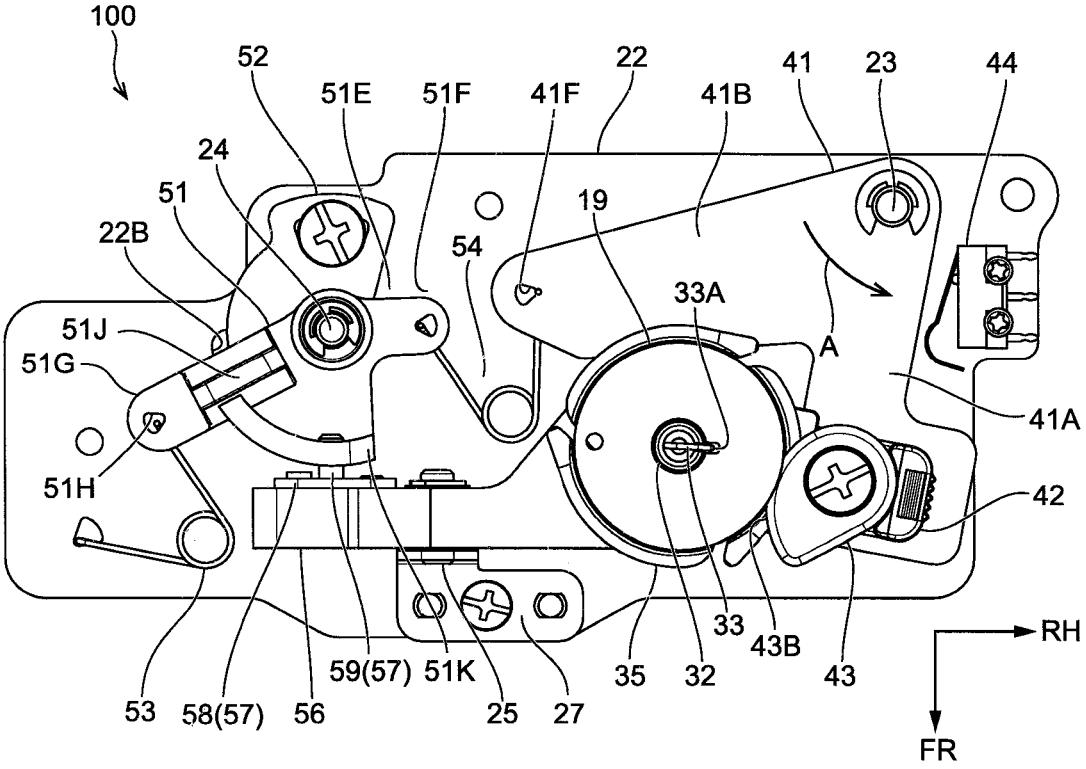
FIG. 19B is a plan view showing a state in which the large-diameter bobbin is mounted on the spool shaft and the detection lever is arranged at the non-pressing position in the large-diameter bobbin mode.
Figure 21A:
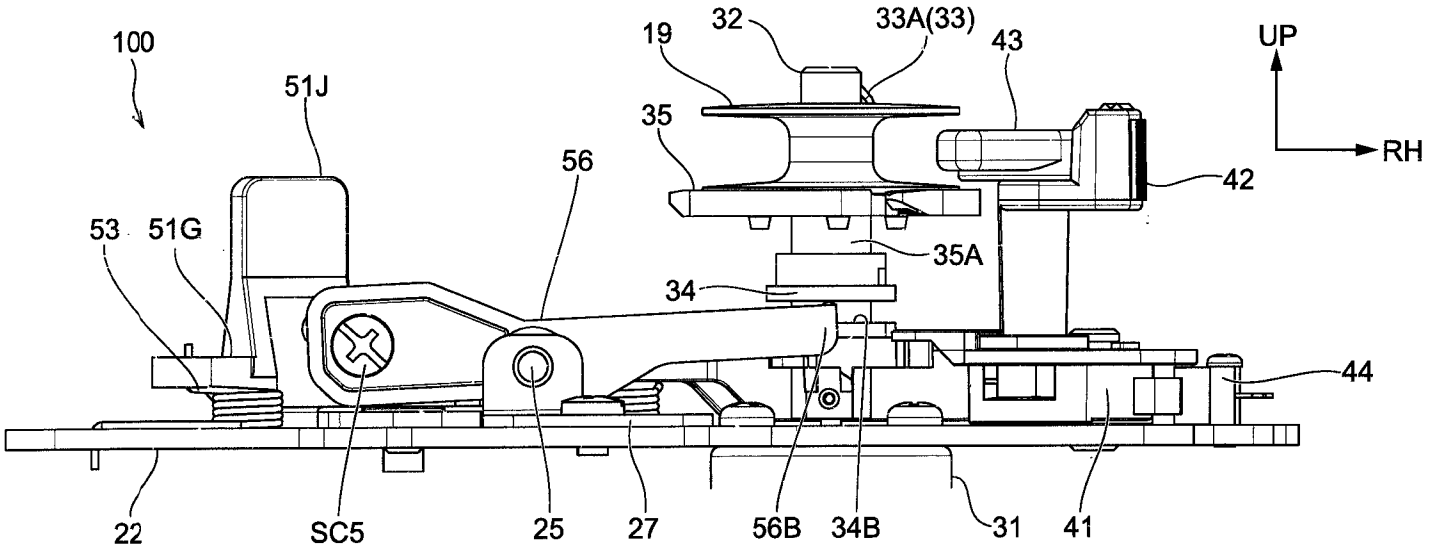
FIG. 21A is a front view of the state shown in FIG. 19B.
Figure 21B:
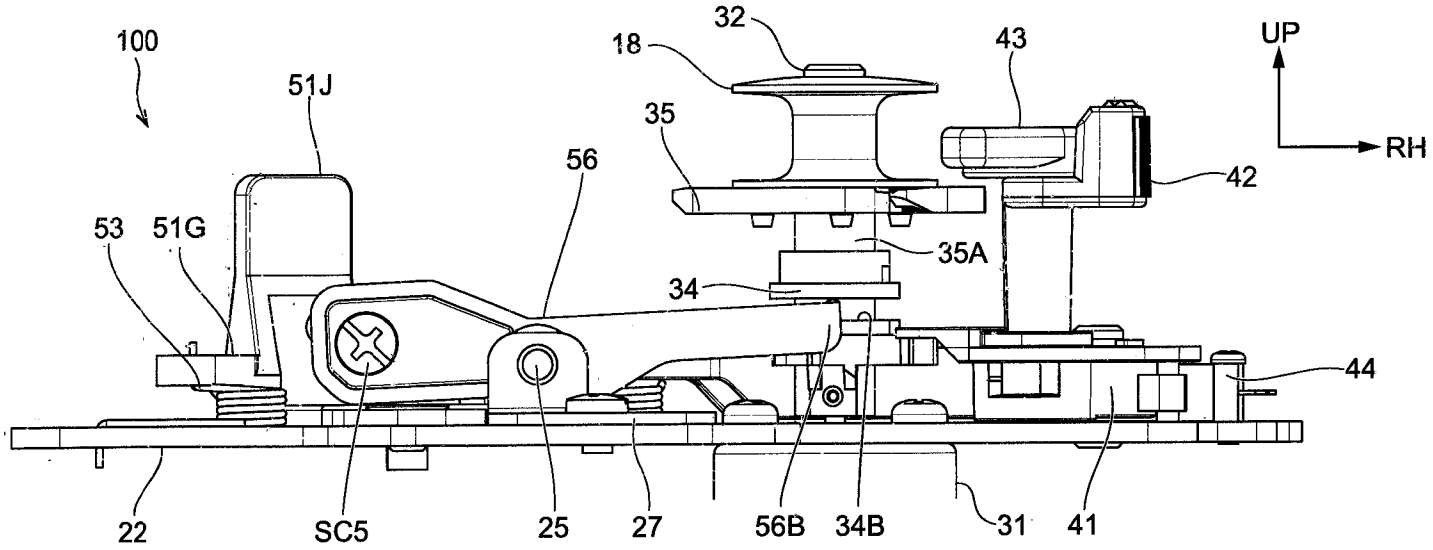
FIG. 21B is a front view which shows the state which the small-diameter bobbin is attached to the spool shaft in the large-diameter bobbin mode.

On the other hand, as shown in FIGS. 19B and 21A, in the large-diameter bobbin mode of the bobbin winding device 100, the thread trimming holder 35 is moved from the lowered position to the raised position by the switching cam 56 and is arranged at the raised position. Further, at this time, since the thread trimming holder 35 is held by the switching cam 56, the switching cam 56 prevents the thread trimming holder 35 from descending from the raised position to the lowered position. Thereby, the bobbin thread can be wound around the large-diameter bobbin 19 by attaching the large-diameter bobbin 19 to the spool shaft 32 and operating the bobbin winding device 100. Further, as shown in FIG. 21B, in the large-diameter bobbin mode of the bobbin winding device 100, the thread trimming holder 35 is arranged and held in the raised position by the switching cam 56. Therefore, when the small-diameter bobbin 18 is mounted on the spool shaft 32, the small-diameter bobbin 18 is arranged above the regular mounting position, and mounting of the small-diameter bobbin 18 at the regular mounting position is prohibited. Therefore, similarly to the first embodiment, if the small-diameter bobbin 18 is attached in the large-diameter bobbin mode of the bobbin winding device 100, the engaging hook 33A of the bobbin stopper 33 does not come out above the core portion 18A of the small-diameter bobbin 18, and the engaging hook 33A and the thread trimming holder 35 do not sandwich the small-diameter bobbin 18 vertically. As a result, even if the spool motor 31 is driven in this state, the small-diameter bobbin 18 idles and the bobbin thread is not wound around the small-diameter bobbin 18.

As described above, even in the second embodiment, it is possible to suppress poor winding of the bobbin thread with respect to the small-diameter bobbin 18 and the large-diameter bobbin 19.

Further, in the second embodiment, as described above, in the small-diameter bobbin mode of the bobbin winding device 100, the thread trimming holder 35 is arranged at the lowered position by the switching cam 56, and in the large-diameter bobbin mode, the thread trimming holder 35 is arranged in the raised position by the switching cam 56. Therefore, if the large-diameter bobbin 19 is erroneously mounted in the small-diameter bobbin mode, or if the small-diameter bobbin 18 is erroneously mounted in the large-diameter bobbin mode, the small-diameter bobbin 18 and the large-diameter bobbin 19 idle, and the bobbin thread is not wound around the small-diameter bobbin 18 and the large-diameter bobbin 19. Therefore, it is possible to effectively suppress poor winding of the bobbin thread with respect to the small-diameter bobbin 18 and the large-diameter bobbin 19.

Although the position adjusting mechanism unit 60 is omitted in the second embodiment, the position adjusting mechanism unit 60 may be provided as in the first embodiment. Further, in the first embodiment (including a variation), the position adjusting mechanism unit 60 may be omitted as in the second embodiment.

Further, in the first embodiment (including the variation) and the second embodiment, although the detection lever 41, the lever operation unit 42, and the lever contact 43 are made of separate members, the detection lever 41, the lever operation part 42, and the lever contact 43 may be made of one member.

DESCRIPTION OF THE REFERENCE NUMERALS

10 sewing machine
12 sewing machine body
12A pedestal portion
12B arm portion
12C bed portion
13 cover
14 thread stand rod
15 thread winding guide
16 operation button
18 small-diameter bobbin (bobbin)
18A core portion
18B flange portion
19 large-diameter bobbin (bobbin)
19A core portion
19B flange portion
20 bobbin winding device
22 base plate
22A regulation hole
22B regulation hole
23 first shaft
24 second shaft
25 third shaft
26 support pin
27 shaft holder
30 thread winding mechanism unit
31 spool motor
31A output shaft
32 spool shaft
32A slit
33 bobbin stopper (engaging member)
33A engaging hook (engaging portion)
34 triangular cam
34A mounting cylinder
34B connecting groove
35 thread trimming holder (holder)
35A mounting portion
35B hook portion
35C thread trimming slit
36 holder stopper
36A insertion hole
36B protrusion
37 holder urging spring
40 thread winding detection mechanism unit
41 detection lever (rotating body)
41A first lever arm
41B second lever arm
41C regulation pin
41D fitting hole
41E lever protrusion
41F locking hole
42 lever operation unit
43 lever contact (contact portion)
43A fixing hole
43B contact portion
44 detection switch (switch)
50 switching mechanism unit
51 switching lever (switching member)
51A protruding portion
51B connecting hole
51C regulation pin
51D switching gear portion (first gear portion)
51E first locking portion
51F first locking hole
51G second locking portion
51H second locking hole
51J handle portion
51K connecting wall portion
51L cam groove
52 lever stopper
52A fixing hole
52B stopper portion
53 lever urging spring
54 switching spring (urging member)
55 interlocking lever (adjustment member)
55A interlocking gear portion (second gear portion)
55B blocking portion
56 switching cam
56A fixing hole
56B cam connecting portion (connecting portion)
57 cam connecting member
58 connecting plate
58A screw portion
58B insertion hole
59 cam pin
60 position adjustment mechanism unit
61 slide member (position change member)
61A slide hole
61B connecting pin
62 adjustment plate (position change member)
62A fixing hole

62B adjustment unit
70 control unit
100 bobbin winding device
SC1 screw
SC2 screw
SC3 screw
SC4 screw
SC5 screw

What is claimed is:

1. A bobbin winding device comprising:

a spool shaft to which a small-diameter bobbin or a large-diameter bobbin having a larger diameter and a shorter shaft length than the small-diameter bobbin is mounted;

an engaging member provided on the spool shaft and having an engaging portion configured to be engageable with the small-diameter bobbin or the large-diameter bobbin mounted on the spool shaft;

a holder that is integrally rotatable on the spool shaft and is movable in the axial direction of the spool shaft, and the large-diameter bobbin is sandwiched with the engaging portion in the axial direction of the spool shaft at the first position, and the small-diameter bobbin is sandwiched with the engaging portion in the axial direction of the spool shaft at the second position on the base end side of the spool shaft with respect to the first position;

a switch which detects the completion of winding of a bobbin thread around the small-diameter bobbin or the large-diameter bobbin mounted on the spool shaft;

a rotating body which is configured to be rotatable around an axis parallel to the spool shaft, and presses the switch by rotating from a non-pressing position separated from the switch to a pressing position via an intermediate position on one side of the rotation direction;

a contact portion provided on the rotating body and configured to be able to contact the bobbin thread, and is arranged radially outside the core portion of the small-diameter bobbin or the large-diameter bobbin at the non-pressing position, and rotates the rotating body to one side in the rotation direction by being pressed by the bobbin thread wound around the small-diameter bobbin or the large-diameter bobbin;

an urging member that urges the rotating body on the other side in the rotating direction at the non-pressing position and on one side in the rotating direction at the pressing position, and switches the urging direction with respect to the rotating body at the intermediate position;

a switching member that is rotatably configured around an axis parallel to the spool shaft and is connected to the urging member, and by rotating from the initial position to the switching position, the intermediate position is changed to one side in the rotation direction of the rotating body, and the bobbin winding mode for the small-diameter bobbin or the large-diameter bobbin is switched from a small-diameter bobbin mode to a large-diameter bobbin mode; and an adjusting member that operates in conjunction with the rotation of the switching member, wherein, in the small-diameter bobbin mode, the small-diameter bobbin is allowed to be mounted at a regular mounting position with respect to the spool shaft; and in the large-diameter bobbin mode, the adjusting member prevents the holder placed in the first position from moving to the second position or moves the holder at the second position to the first position so that the adjusting member prohibits the small-diameter bobbin from being mounted at a regular mounting position with respect to the spool shaft, or prevents the rotation of the holder at the second position.

2. The bobbin winding device according to claim 1, comprising a position-changing member configured to be movable in conjunction with the rotation of the switching member and to be able to be in contact with the rotating body at the non-pressing position, wherein in the large-diameter bobbin mode, the non-pressing position is changed to one side in the rotation direction of the rotating body when the rotating body comes into contact with the position changing member.

3. The bobbin winding device according to claim 1, wherein, in the small-diameter bobbin mode, the adjusting member is arranged at a permitted position away from the holder, and in the large-diameter bobbin mode, the rotation of the holder is prevented by moving the adjusting member to a blocking position close to the holder and causing the holder at the second position to directly or indirectly contact the adjusting member.

4. The bobbin winding device according to claim 1, wherein, in the small-diameter bobbin mode, the adjusting member is arranged at a permitted position away from the holder, and in the large-diameter bobbin mode, the movement of the holder from the first position to the second position is prevented by moving the adjusting member to a blocking position on the base end side of the spool shaft with respect to the holder, and the holder directly or indirectly contact the adjusting member.

5. The bobbin winding device according to claim 3, wherein, a first gear portion is formed on the switching member, the adjusting member is configured to be rotatable around an axis parallel to the spool shaft, and it is configured to include a second gear portion meshed with the first gear portion and a blocking portion configured so as to be able to directly or indirectly contact the holder.

6. The bobbin winding device according to claim 1, wherein, the adjusting member connects the switching member and the holder, and configured to be able to switch the position of the holder to the first position or the second position by operating the adjusting member, and the holder is arranged at the second position in the small-diameter bobbin mode, and the holder is moved to the first position by the adjusting member in the large-diameter bobbin mode.

7. The bobbin winding device according to claim 6, wherein, a cam groove is formed in the switching member, the adjusting member is configured to be rotatable around an axis intersecting the spool shaft, and includes a cam pin engaged with the cam groove and a connecting portion connected to the holder.

8. A sewing machine comprising the bobbin winding device according to claim 1.

* * * * *